US007441506B2

(12) United States Patent
Bruns

(10) Patent No.: US 7,441,506 B2
(45) Date of Patent: Oct. 28, 2008

(54) ROADWAY VEHICLE TRANSPORTATION SYSTEM AND METHOD

(76) Inventor: John H. Bruns, 8251 SE. 26, Mercer Island, WA (US) 98040

( * ) Notice: Subject to any disclaimer, the term of this patent is extended or adjusted under 35 U.S.C. 154(b) by 357 days.

(21) Appl. No.: 11/119,507

(22) Filed: Apr. 30, 2005

(65) Prior Publication Data

US 2006/0243155 A1 Nov. 2, 2006

(51) Int. Cl.
*B61B 1/00* (2006.01)

(52) U.S. Cl. ..... 104/89; 104/118

(58) Field of Classification Search ..... 104/89, 104/90, 91, 94, 96, 118, 121; 180/14.1, 401; 414/340, 373
See application file for complete search history.

(56) References Cited

U.S. PATENT DOCUMENTS 3,777,670 A * 12/1973 Blochlinger ..... 104/246
3,828,681 A * 8/1974 Christensen et al. ..... 104/88.06
3,929,077 A * 12/1975 Benndahl ..... 104/93
5,007,496 A * 4/1991 Whitten et al. ..... 180/401

* cited by examiner

*Primary Examiner*—S. Joseph Morano
*Assistant Examiner*—Robert J McCarry, Jr.

(57) ABSTRACT

Generally and not exclusively, there is disclosed a system and a method for towing (pushing or pulling) a roadway vehicle on a road by a towing apparatus. The towing apparatus is coupled to a roadway guideway displaced generally above the surface of the roadway. In an embodiment, the system includes an apparatus to couple a vehicle to the roadway guideway, a force generation unit to move the coupled vehicle along the roadway guideway, and a brake unit to decelerate the apparatus and a coupled vehicle. In an embodiment, the system includes a coupling unit to separately couple or not couple the vehicle to one of multiple separate components of the roadway guideway, so that the towing apparatus, and therefore a towed vehicle, can switch roadway guideways by coupling to one or another component of the roadway guideway.

19 Claims, 11 Drawing Sheets

ROADWAY VEHICLE TRANSPORTATION SYSTEM AND METHOD

TECHNICAL FIELD

This invention relates generally to vehicle transportation systems, and more particularly but not exclusively to a system and method for towing a roadway vehicle on a road by a towing apparatus that is coupled to a roadway guideway.

BACKGROUND

The many attempts to modernize surface transportation for people, in systems both public and private, have brought along many interesting embodiments. The system and method described herein provide both a novel and a non-obvious way of addressing the generic corridor needs of today's vehicles, and establishes a standard for the future. In an embodiment, a common energy element of electricity is clean, and tending into "green" and cheap, which helps to defer both initial capital and operating expenses.

Embodiments follow principal criteria of reducing the usage of petroleum as a fuel, of improving lane capacity or throughput on roadways, and of providing panic-stop capability for minimizing injury including the effects of an earthquake. An embodiment may include affordable and maintainable hardware and software systems and components that are selectively redundant to enhance safety and reliability.

The inventor hopes to continue the spirit of the Eisenhower Interstate Highway design near its fiftieth anniversary.

BRIEF DESCRIPTION OF THE FIGURES

Non-limiting and non-exhaustive embodiments are described with reference to the following figures, wherein like reference numerals refer to like parts throughout the various views unless otherwise specified. With regard to described methods, the order of description should not be construed to imply that these operations are necessarily order dependent.

DETAILED DESCRIPTION

In the following description, numerous specific details are set forth in order to provide a thorough understanding of the invention. Some structures, elements, methods, actions, and/or other details may not be described in order to avoid obscuring the invention. Moreover, although specific embodiments are described herein, it will be appreciated that each of these embodiments is illustrative, and that a wide variety of alternate and/or equivalent structures, elements, methods, actions, and/or embodiments may be substituted for the specific structures, elements, methods, actions, and/or embodiments shown and described, without departing from the invention.

Figure 1:
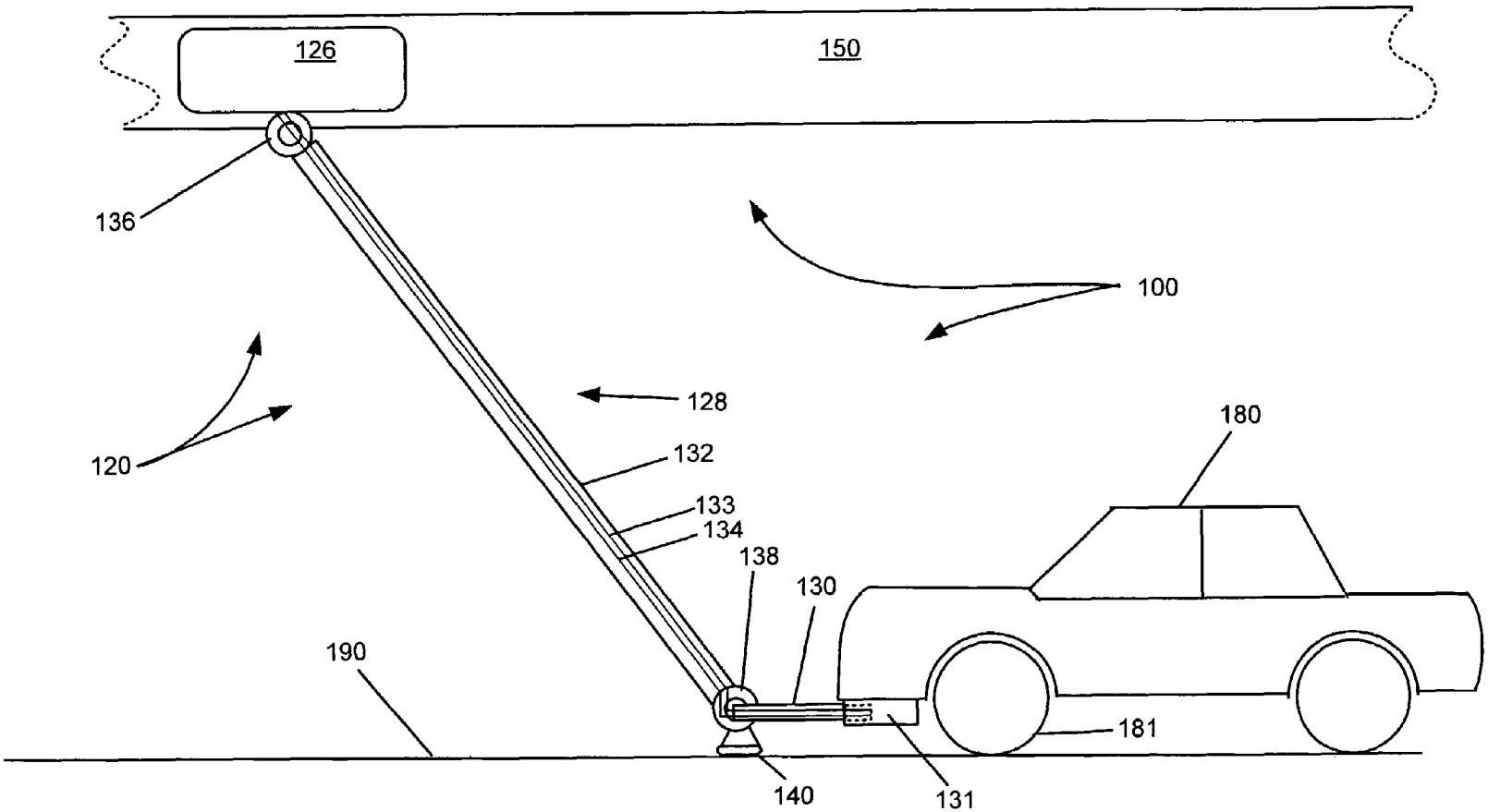
FIG. 1 portrays a side view diagram of an embodiment of a vehicle transportation system comprising a roadway guideway and an apparatus for coupling the roadway guideway to a vehicle and powering the apparatus and vehicle.

Turning now to FIG. 1, there is portrayed an embodiment of a vehicle transportation system 100. The vehicle transportation system 100 includes an apparatus 120. The apparatus 120 is configured in an embodiment to couple a roadway guideway 150 to an illustrative roadway vehicle 180. In embodiments, a roadway vehicle 180 may illustratively be embodied as an automobile, a bus, a van, a truck, a tram, and other conveyances including those specially configured to take advantage of this disclosure. The apparatus 120 is configured in an embodiment to generate a force to move the apparatus 120 along the coupled roadway guideway 150 and the coupled roadway vehicle 180 along an illustrative roadway 190 on which the roadway guideway 150 is operationally positioned, as the apparatus 120 moves along the roadway guideway 150. The positioning of a roadway guideway 150 relative to a roadway 190 is additionally described with reference to FIG. 9.

The apparatus 120 is illustratively portrayed here as being coupled to both the roadway guideway 150, and to the roadway vehicle 180. The roadway vehicle 180 is portrayed as being positioned on the roadway 190. In an embodiment, the usual roadway vehicle 180 may have turning wheels 181 to turn about an approximate vertical axis (in addition to rolling), facilitating the roadway vehicle 180 in yawing when the roadway vehicle 180 is under tow by the apparatus 120 and is subject to a yawing force imposed by the apparatus 120. Illustrative turning movements may include being turned around roadway curves, and having a course altered within a roadway lane.

The apparatus 120 is configured to impart the towing, which may be a pushing or a pulling force, to a coupled roadway vehicle 180, as the apparatus 120 moves along the roadway guideway 150 whereby the roadway vehicle 180 is towed along the roadway guideway 150 and along the roadway 190. The towing force may include a longitudinal force, and/or a yawing (steering) force (relative to the roadway vehicle 180). In an embodiment, the apparatus 120 is configured to impart a braking force to a coupled roadway vehicle 180 as the apparatus 120 decelerates in its movement along the roadway guideway 150. The apparatus 120 is configured to withstand the towing force, to withstand the braking force that it imparts to the coupled vehicle 180, and to withstand the response of the coupled vehicle 180 to the imparted towing force and braking (or deceleration) force.

The portrayed apparatus 120 includes a head unit 126. The head unit 126 includes in an embodiment those components of the apparatus 120 that interact with the roadway guideway 150. In an embodiment, the head unit 126 includes the structures of the apparatus 120 that are operative to couple the apparatus 120 to the roadway guideway. These structures are termed herein a guideway coupling structure (not shown). In an embodiment, the head unit 126 includes the structures of the apparatus 120 that are operative to apply a propulsive force against the roadway guideway to move that apparatus 120 along the roadway guideway 150. These structures are termed herein a force generation unit (not shown). In an embodiment, the head unit 126 includes a braking system (not shown) operative to apply a force to retard the motion of the head unit 126 along the roadway guideway 150. In an embodiment, the braking system includes pinch brakes operative to apply a frictional force to a surface of the roadway guideway 150. Exemplary embodiments of the guideway coupling structure are shown and further described presently with reference to FIGS. 3, 4, 7, 8, and 11A and 11B. As described presently, the guideway coupling structure are operative to switch the apparatus along alternative paths and can also be termed switching components, and/or as path selection components.

The guideway coupling structure is configured to physically couple the apparatus 120 to the roadway guideway 150, a longitudinal section thereof, a guideway structure, or the like. As used herein, a longitudinally disposed section of a roadway guideway may mean a longitudinally disposed section of the roadway guideway to which a head unit may physically couple. A roadway guideway comprises at least one longitudinally disposed section. As used herein, a roadway guideway structure may include one or more longitudinally disposed sections to which an individual apparatus 120 may separately physically couple. As used herein, to physically couple with respect to a roadway guideway, a longitudinally disposed section thereof, a roadway guideway structure, or the like, may mean to constrain within a prescribed approximate lateral position with respect to the roadway guideway, the longitudinally disposed section thereof, or the roadway guideway structure, and to permit or assert for movement longitudinally along the roadway guideway, the longitudinally disposed section thereof, the roadway guideway structure, or the like. And similarly, as used herein, to be physically coupled with respect to a roadway guideway, a longitudinally disposed section thereof, a roadway guideway structure, or the like, may mean to be approximately constrained within a prescribed approximate lateral position with respect to the roadway guideway, the longitudinally disposed section thereof, or the roadway guideway structure, or the like, and to be able to move longitudinally along the roadway guideway, the longitudinally disposed section thereof, the roadway guideway structure, or the like.

Further, reference may be made herein to a roadway guideway. Unless otherwise noted, that reference may also apply to a longitudinally disposed section thereof, to a roadway guideway structure, and the like.

An embodiment of the force generation unit is shown and further described with reference to, FIGS. 3, 5, and 7. The force generation unit is configured to generate a force to move the apparatus 120 along the coupled roadway guideway 150, and to move the coupled roadway vehicle 180 along in the general or approximate direction of the apparatus 120 along the roadway guideway 150, or the like. The force to move the apparatus 120 along the coupled roadway guideway 150 may be termed herein a first force. The force to move the coupled roadway vehicle 180 over a roadway may be termed herein a second force.

The portrayed apparatus 120 includes a vehicle coupling structure 128. In an embodiment, the vehicle coupling structure 128 is configured to physically couple the head unit 126 to the roadway vehicle 180; to transmit to, and exert upon, the coupled roadway vehicle 180 the second force from the apparatus 120; and to transmit to, and apply, a braking force to the coupled roadway vehicle 180. In an embodiment, the head unit 126 includes a vehicle coupling structure positioning unit (not shown) to position the angular orientation of the vehicle coupling structure 128 (described below) relative to the head unit 126 and/or the roadway guideway 150. The vehicle coupling structure 128 may include a force actuating unit such as an electric motor, or an hydraulic motor, that is configured to rotate the vehicle coupling structure 128 to selected angular positions. In an embodiment, the vehicle coupling structure positioning unit is configured to rotate the vehicle coupling structure about a vertical axis to a prescribed trailing (or yawing) angle relative to the head unit 126, to assume a predetermined trailing angle when towing (pulling or pushing) a coupled vehicle 180. In an embodiment, the vehicle coupling structure positioning unit is configured to rotate the vehicle coupling structure about a vertical axis to a prescribed position along the head unit 126, such as to operationally deploy the vehicle coupling structure 128 in a position when an apparatus 120 is not engaged in coupling to a roadway vehicle 180.

In an embodiment, the vehicle coupling structure 128 comprises a vehicle engagement structure 130. The vehicle engagement structure 130 is configured to engage the roadway vehicle 180, or alternatively to engage a structure 131 attached to the roadway vehicle 180, to couple the apparatus 120 to the roadway vehicle 180. In an embodiment, the vehicle coupling structure 128 is configured to removably engage, or to removably couple to, the roadway vehicle 180, or a structure 131 of the roadway vehicle 180; and in an embodiment to removably engage or to removably couple to the apparatus 120 with a breakaway force. In the portrayed embodiment, the vehicle engagement structure 130 is to couple to the vehicle 180 from the front end of the vehicle 180. In an embodiment, the vehicle coupling structure 128 is configured to couple to the vehicle 180 approximately symmetrically about the longitudinal geometric centerline and/or the longitudinal center of gravity of the vehicle 180, such as by having forks disposed symmetrically about the centerline in the coupled position. Moreover, in an embodiment the vehicle coupling structure 128 comprises a member 132 configured to approximately span the distance between the head unit 126 of the apparatus 120 and the roadway vehicle 180. In an embodiment, the member 132 is further configured to articulate, and/or to telescope, so as to adjust its angle relative to the head unit 126 of the apparatus 120 and/or the roadway vehicle 180, and to adjust its reach. The member 132 is operative to adjust its angle and its reach to accommodate coupling the head unit 126 to the roadway vehicle 180 for multiple dispositions of the roadway guideway 150 relative to the roadway vehicle 180.

In an embodiment, the vehicle coupling structure 128 includes a joint 136 coupled between the member 132 and the head unit 126, operative to enable the member 132 to be pivotable in prescribed axes of rotation and ranges of rotation with respect to the coupled head unit 126. Further, in an embodiment the vehicle coupling structure 128 includes a joint 138 coupled between the member 132 and the engagement structure 130/vehicle 180 to enable the member 132 to be pivotable in prescribed axes of rotation and ranges with respect to the coupled engagement structure 130, and/or vehicle 180. The joint 138 may reduce or prevent rotational forces from the roadway vehicle 180 being applied to the head unit 126. In an embodiment, the joint 138 is elastic with respect to rolling about a lengthwise axis of a coupled vehicle, such that the joint may roll momentarily in response to a torque about an axis that may be approximately aligned with lengthwise axis of a coupled vehicle, and then approximately return to longitudinal alignment. Moreover, in an embodiment the joint 138 is elastic with respect to yawing about an axis that may be approximately vertical when the apparatus 120 is coupled to a vehicle, such that the joint may yaw momentarily in response to a torque about the vertical axis, and then approximately return to lateral alignment.

In an embodiment, the joint 136 and/or the joint 138 are gimbaled structures, and in an embodiment, the joint 136 and/or the joint 138 compose a system of trunnions that are operative to pivot in prescribed axes of rotation and ranges. In an embodiment, the joint 136 and/or the joint 138 mate with yokes positioned at either end of the member 132.

In an embodiment, the member 132 and/or the engagement structure 130 include an engagement structure positioning unit (not shown) to position the angular orientation of the engagement structure 130 relative to the member 132 and/or the vehicle 180, by positioning the joint 138.

In an embodiment, the vehicle coupling structure 128 includes a data connection 133 to transmit data to a coupled programmed computer (FIG. 8) from a user interface of the vehicle 180, and/or to transmit data from a coupled programmed computer (FIG. 8) to a user interface of the vehicle 180.

In an embodiment, the vehicle coupling structure 128 includes an electric conductor 134 to transmit electric power to a coupled roadway vehicle 180. In an embodiment, the voltage is to be maintained at a level that can be tolerated by humans, so that high electric power is approximately caused by a corresponding high electric current transmittable through the conductor 134. The conductor 134 is configured to transmit this current.

In an embodiment, the apparatus 120 is configured of adequate strength and structural rigidity to withstand the braking and the acceleration forces that the head unit 126 and the engaged vehicle 180 impose upon the apparatus 120. In particular, the member 132 is of sufficient torsional stiffness/compliance to operate correctly to withstand and/or to compensate for the roll-yaw coupling with the vehicle 180, and to compensate for vehicle 180 list up during a towing operation.

In an embodiment, the apparatus 120 may include a device 140 to contact the roadway 190 when the apparatus 120 is coupled to a vehicle 180. The device 140 is joined to the coupling structure 128, such as illustratively at the joint 138. It is understood that in an application of brakes of the apparatus 120 against the roadway guideway 150, the resultant deceleration of the apparatus 120 may transmit a deceleration force down the vehicle coupling structure 128. The portrayed arrangement of the vehicle coupling structure 128 may resolve the transmitted force into a downward component. The downward component encourages the joined device 140 to contact the roadway 190, and to press against the roadway 190 to contribute to the rearward deceleration of the vehicle coupling structure 128 and the coupled roadway vehicle 180.

In an embodiment, the roadway 190 may have one or more grooves along the roadway 190 at a lateral position in the roadway 190 that are configured to contain the device 140. In operation of the device 140, the device 140 may be contained within the grooves. The device 140 in being contained within the grooves is constrained within an approximate lateral position on the roadway 190. The device 140 may be horizontally biased to remain within the grooves in response to a vehicle 180 tending to yaw because of small applied torquing forces as the vehicle 180 moves along the roadway 190.

In an embodiment, the device 140 may be configured to include a sole plate having a friction facing and/or a series of springy bristles resembling in form a wire brush, or other projections. These projections increase the surface area of the in-contact portion of device 140. The friction facing, and further the projections, may contribute to the generated frictional force as the device 140 moves in contact with the roadway 190 to further decelerate the apparatus 128—coupled vehicle 180 combination as it moves and contacts the roadway 190. It is understood that the induced frictional forces generated by the in-contact device 140 and its projections may reduce stresses within the head unit 126, and/or upon the guideway 150. In a circumstance in which the guideway 150 is offset from the vehicle 180, the downward force in the structure 128 may have a sideward (lateral) component. In an embodiment, the device 140 is operative to react against this force to retard lateral movement. In the embodiment in which the roadway has grooves and a portion of the device 140 (such as the projections) is disposed within the grooves, the projections may bear against the grooves to increase the lateral and decelerating frictional force.

The vehicle transportation system 100 may moreover include the roadway guideway 150. Exemplary roadway guideways, and roadway guideway structures, are described presently with referenced to FIGS. 3, 4, 5, 7, and 8.

Figure 2:
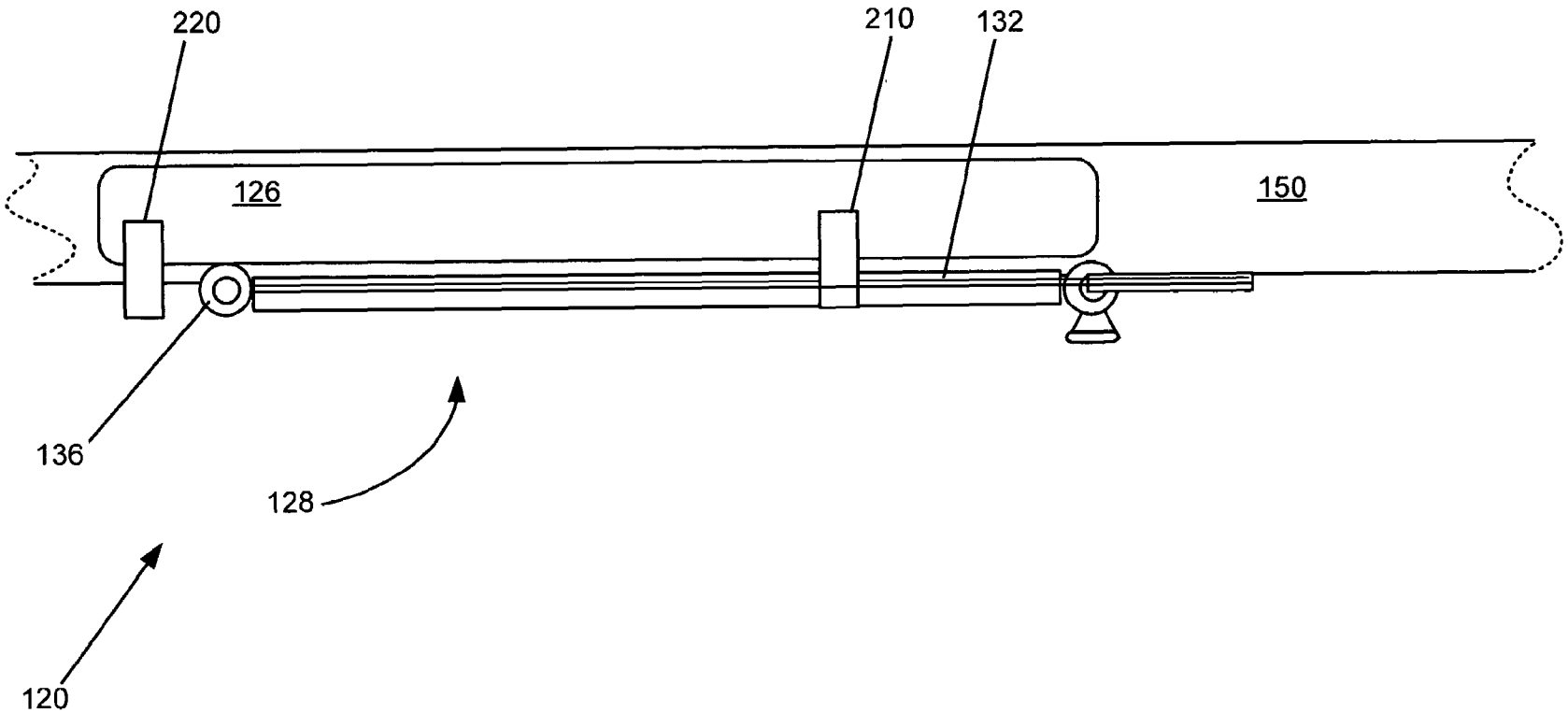
FIG. 2 portrays an embodiment of the apparatus, wherein the vehicle coupling structure is positioned in a trailering position.

Referring now to FIG. 2, in an embodiment the vehicle coupling structure 128 is configured to be positionable in a retracted position when it is not coupled to a roadway vehicle, e.g. in a position proximate and along the head unit 126. As described with reference to FIG. 1, in an embodiment the vehicle coupling structure positioning unit, or other unit of the vehicle transportation system 100, may be configured to position the vehicle coupling structure 128 in and/or out of the retracted position. In an embodiment, the vehicle coupling structure positioning unit, or other unit, is configured to position the vehicle coupling structure 128 by positioning the member 132. In an embodiment, the vehicle coupling structure positioning unit, or other unit, is configured to position the vehicle coupling structure 128 by rotating the vehicle coupling structure 128 about the head unit 126. The apparatus 120 may include a holding unit 210 to hold the coupling structure 128 in the retracted position. In an embodiment, the engagement structure 130, or other structure of the coupling structure 128, may be mechanically coupleable to an apparatus (not shown) aft of the apparatus 120 along the roadway guideway 150. By being mechanically coupleable to an apparatus aft of the apparatus 120 along the roadway guideway 150, other apparatuses may be double-headable to the apparatus 120. A head unit 126 includes a vehicle coupling structure attachment unit 220 to attach to a vehicle coupling structure 128 of another apparatus 120 for being double-headed to the other apparatus 120. In an embodiment, the vehicle engagement structure 130 of the other apparatus 120 is to be attachable to the vehicle coupling structure attachment unit 220. The head unit 126 is illustratively portrayed as a more elongated structure than the head unit 126 of FIG. 1, to abet the member 132 to couple to a head unit 126 at a greater distance along the member 132. The portrayed disposition of the engagement structure 130 is illustrative of embodiments for coupling the engagement structure 130 to a vehicle coupling structure attachment unit composing an apparatus positioned aft of the apparatus 120.

Figure 3:
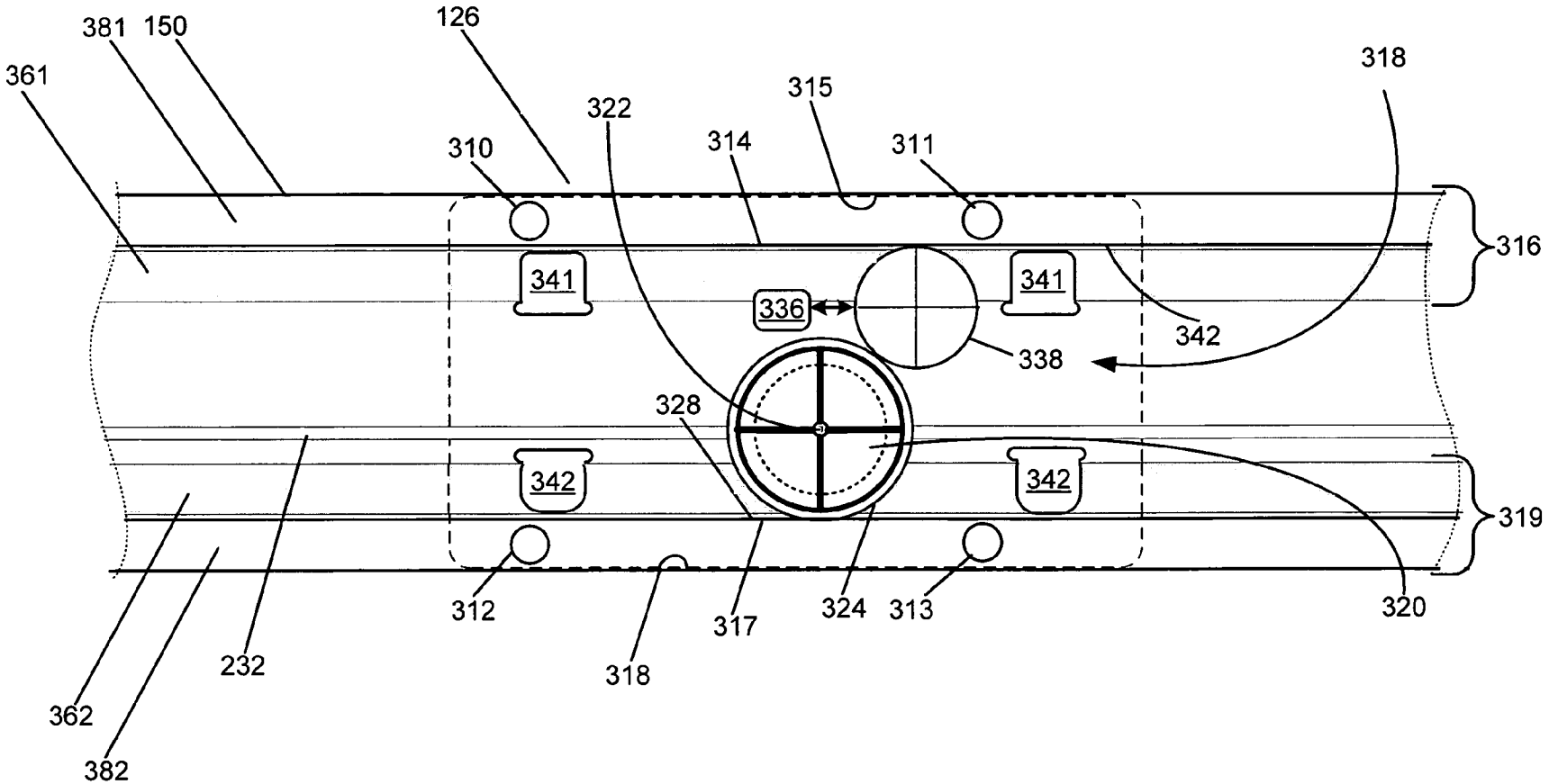
FIG. 3 portrays a top view diagram of an embodiment of a roadway guideway and a coupled apparatus having coupling components, for coupling the roadway guideway to a vehicle.

Referring now to FIG. 3, an embodiment of the head unit 126 of the apparatus 120 includes horizontal guideway coupling components 310, 311, 312, and 313, illustratively embodied as wheels or sliders. As described with reference to FIG. 1, a horizontal guideway coupling component is configurable to horizontally couple the apparatus 120 to the roadway guideway 150, a longitudinally disposed section thereof, a roadway guideway structure, or the like.

Each of the portrayed horizontal guideway coupling components 310, 311, 312, and 313 is embodied illustratively as a cylinder positioned within, or to contact, respective opposed longitudinally disposed surfaces of the roadway guideway 150; surfaces 314 and 315 for guideway coupling components 310 and 311, and surfaces 317 and 318 for guideway coupling components 312 and 313. Illustrative front view embodiments of a guideway, and coupling components of the head unit 126, are described with reference to FIGS. 4 and 7. By being operatively positioned within these respective surfaces, a coupling component is constrained to positions within these surfaces, and the apparatus 120 is physically coupled to the roadway guideway 150. In an embodiment, the coupling components 310, 311, 312, and 313 are made of a resilient material, and/or are covered with a resilient material such as a rubber compound, and configured to be rotatable. In an embodiment, the coupling components 310, 311, 312 are made of a material, and/or are covered with a material, having a low coefficient of friction; and/or the surfaces that enclose a coupling component are made of, or covered with, a material having a low coefficient of friction, or a bearing structure. In an embodiment, the roadway guideway 150 may include a channel (or chamber or pocket or the like), and a coupling structure of the apparatus 120 may be operationally disposed within the channel, and constrained to positions within the channel so that the apparatus 120 is physically coupled to the roadway guideway 150. It is specifically understood that this is merely an illustrative embodiment, and many other embodiments may be employed to horizontally couple the apparatus 120 to the roadway guideway 150.

In the portrayed embodiment, the head unit 126 moreover includes a vertical coupling structure to couple the apparatus 120 vertically to the roadway guideway 150, or a longitudinally disposed section thereof. It is specifically understood that the structure of the apparatus 120 to physically couple the apparatus 120 to a roadway guideway 150 may not be the same structure to couple the apparatus 120 in a vertical position with respect to the roadway guideway 150. In an embodiment, the vertical coupling structure comprises wheels 341 and 342 operative to roll respectively on a horizontal surface 361 and 362 of the guideway 150, and to support the apparatus 120 vertically on the roadway guideway 150. In the portrayed embodiment, the wheel structures 341 342 illustratively include a flanged sidewall operative to overlap a side of the respective supporting surfaces 361 362. In the embodiment, the vertical coupling structure may also physically couple in whole or part the apparatus 120 to the roadway guideway 150. It is specifically understood that this is merely an illustrative embodiment, and many other embodiments may be employed to couple the apparatus 120 in the vertical direction to the roadway guideway 150, or to maintain the head unit 126 in a range of adequate vertical positions to permit the head unit 126 to horizontally couple to the roadway guideway 150, or a longitudinally disposed roadway section or roadway structure thereof. In yet another illustrative embodiment, the vertical coupling structure 341 may be disposed on the horizontal surface 381 of the roadway guideway 150 in the pocket defined by the surfaces 314 and 315, and the roadway guideway 150 may not include the surface 361; and/or the vertical coupling structure 342 may be disposed on the surface 382 of the roadway guideway 150 in the pocket defined by the surfaces 317 and 318, and the roadway guideway 150 may not include the surface 362. In an embodiment, a vertical coupling structure may maintain the head unit 126 in a positive as well as in a negative vertical position with respect to the head unit 126, to constrain the position of the head unit 126 both up and down. Other illustrative embodiments of a vertical coupling structure are portrayed with reference to FIGS. 4 and 7.

The portrayed roadway guideway 150 includes two longitudinally disposed sections to be separately coupleable by the apparatus 120; illustratively a roadway guideway first section 316 and a roadway guideway second section 319. The roadway guideway first section 316 here includes illustratively the surfaces 314 315 and the pocket formed therefrom. One set of the coupling components of the apparatus 120, illustratively the coupling components 310 and 311, are configurable to physically couple to the pocket. The first section moreover includes the surface 361.

The roadway guideway second section 319 here includes illustratively the surfaces 317 318 and the pocket formed therefrom. One set of the coupling components of the apparatus 120, illustratively the coupling components 312 and 313 are configurable to physically couple to the pocket. The second section moreover includes the surface 362.

In configurations of the roadway guideway, as shall be further described with reference to FIGS. 4, 5, 7, 8, and 11A and 11B, each of these separate sections may diverge from one another, wherein the apparatus 120 may be physically coupled to only one of the sections, and therefore in operation go along the coupled-to section, and not the section to which it is not coupled. Thus in this description, the apparatus may be described as being physically coupled to the roadway guideway, and may also be described as being physically coupled to a section of a roadway guideway, or to a roadway guideway structure. In the description, when the apparatus 120, or parts thereof, are described as being coupled or coupleable to a roadway guideway, they may be coupled or coupleable to only a longitudinally disposed guideway section.

The coupling components are configured to be operative to physically couple, or not to physically couple, to their respective roadway guideway sections in response to a determination to physically couple or to not physically couple to the respective roadway guideway section, and are therefore switchable to physically couple and to physically decouple to the roadway guideway or the roadway guideway section. An embodiment to control the physical coupling or the not physical coupling of an apparatus 120 coupling structure to a roadway guideway section is described presently with reference to FIGS. 4, 7, 8, and 11A and 11B. In operation of an apparatus 120 along a roadway guideway 150, the physical coupling components may be operated to physically couple to one section, and not physically couple to the other section of the roadway guideway 150, so that where the roadway guideway sections diverge along two separate routes, e.g. at an intersection entrance or an exit of a roadway. As described with reference to FIG. 8, and FIGS. 11A and 11B, the apparatus 120 would move along the physically coupled-to section, and not move along the uncoupled-to section, thus taking the route of the physically coupled-to section. In this sense, the coupling components may be thought of as switching components, and/or as path selection components, and may be referred to as such.

It is specifically understood that innumerable of embodiments of coupling components are within the scope of the invention, as well as innumerable embodiments of the separate roadway guideway sections. For instance, a particular illustrative mechanical coupling structure has been, and will be, described with reference to FIGS. 3, 4, and 7, but it is specifically understood that there are other coupling structure embodiments, such as magnetic physical coupling structure embodiments, and hydraulic physical coupling structure embodiments. It is also specifically understood that while two horizontally opposed guideway coupling structures and sections have been portrayed with reference to FIG. 3, and will be portrayed as well with reference to FIGS. 4, 5, 7, and 8, in embodiments there may be at least two vertically and/or horizontally opposed sets of guideway coupling structures and sections, each set comprising one or more separate guideway coupling structures, each separate guideway coupling structure associated with a specific coupling component configurable to physically couple the apparatus 120 to the separate guideway coupling structure and configured to physically couple or not physically couple together to the apparatus 120.

The apparatus 120 moreover includes the force generation unit 318. The force generation unit 318 is configured to convert a received energy into a movement of the apparatus 120 along the roadway guideway 150 (a longitudinally disposed section thereof, a roadway guideway structure, or the like). In an illustrative embodiment, the force generation unit 318 is configured to convert the received energy into a rotation of an element 324 against a surface of the roadway guideway 150, wherein the rotating element 324 is configured to react to (or against) the surface (or element) of the roadway guideway 150, and thereby cause the apparatus 120 to move along the roadway guideway 150.

In the portrayed embodiment, the force generation unit 318 includes a force generation machine 320 to convert the received energy into a movement. In an implementation, the force generation machine 320 includes an electric motor 320. In an embodiment in which the received energy is electric power source 332, commonly implemented as a "third rail," is disposed along the roadway guideway 150, a longitudinally disposed section thereof, a roadway guideway structure, or the like) illustratively below the electric motor 320. The force generation unit 318 is configured to electrically couple to the electric power source such that an operative electric motor 320 receives electric power from the electric power source 332, and converts the received power into the movement. It is specifically understood that the force generation unit 318 may include other units, such as circuits, to control and/or transform the voltage of the voltage source into a voltage that the motor 320 may operate upon. In an embodiment, the electric motor 320 is a pancake design operable to induce rotation around an illustrative vertical axis. Moreover, in an embodiment the electric motor 320 is positioned in the head unit 126 aft of the position at which the joint 136 or the member 132 couples to the head unit 126.

In an embodiment, a shaft 322 of the motor 320 is operatively coupled to a circular cylinder 324 that is illustratively horizontally disposed, and the circular cylinder 324 is disposed to press against an illustrative vertical surface 328 of the roadway guideway 150 (or a section thereof). The cylinder 324 along its periphery has a coefficient of friction when used with surface 328. In an embodiment, the cylinder 324 may be coated with a material that improves the coefficient of friction. In an embodiment, the surface 328 may improve the coefficient of the surface of the cylinder 324. The pressing force and the coefficient of friction between the cylinder or coated material and for the surface 328, are such that the cylinder 324 maintains a grip on the roadway guideway 150 as the cylinder 324 rotates. The cylinder 324 is therefore operable to roll along the inner wall of the roadway guideway 150 (or a roadway guideway structure), and the apparatus 120 is therefore operable to move along the coupled roadway guideway 150. In an embodiment, a portion of the cylinder 324 in contact with the surface 328 is resilient, and is disposed to press against the surface 328. In an embodiment, the surface 328 is resilient. In an embodiment, the force generation unit 318 further includes a biasing drive unit 336 operative to apply a force to press the cylinder 324 against the surface 328. In an embodiment, the biasing drive unit 336 includes a spring loaded device or other resilient device. Illustratively, the force generation unit 318 includes an idler wheel 338 translatably mounted on a fixture of the head 126, and coupled to the biasing drive unit 336. The biasing drive unit 336 is configured to translate the idler wheel 338 into a wedged position between a surface 342 of the roadway guideway 150 and the cylinder 324, such that it imposes a force to press the cylinder 324 against the surface 328. In an embodiment, the idler wheel 338 has a coefficient of friction with respect to the surface 328. In an embodiment, the idler wheel 338 in response to a rotating cylinder 324, is induced to rotate, and is operable to induce a force against the surface 328, and to roll and to induce a roll along the roadway guideway on the surface 312. Further, in another illustrative embodiment, a motor may generate a force to rotate a coupled gear along a cog disposed along a surface of the roadway guideway 150, to translate the apparatus 120 along the roadway guideway 150 (or a section thereof). In an embodiment, the force generation unit further includes a blower 340 to blow air onto the motor and/or the place of contact of the cylinder 324 against the surface 328, for maintaining a desired temperature range in the motor 320 and/or the place of contact, and/or other uses such as air bearings.

In an embodiment, the force generation unit 318 may include more than one motor, each motor operative either to rotate a separate cylinder and/or assist a central computer, that in operation is coupled against a distinct roadway guideway structure and/or longitudinally disposed section thereof. Moreover, in an embodiment, a motor 320 may separately drive multiple cylinders, each cylinder coupled against a distinct roadway gateway structure and/or longitudinally disposed section thereof.

Figure 4:
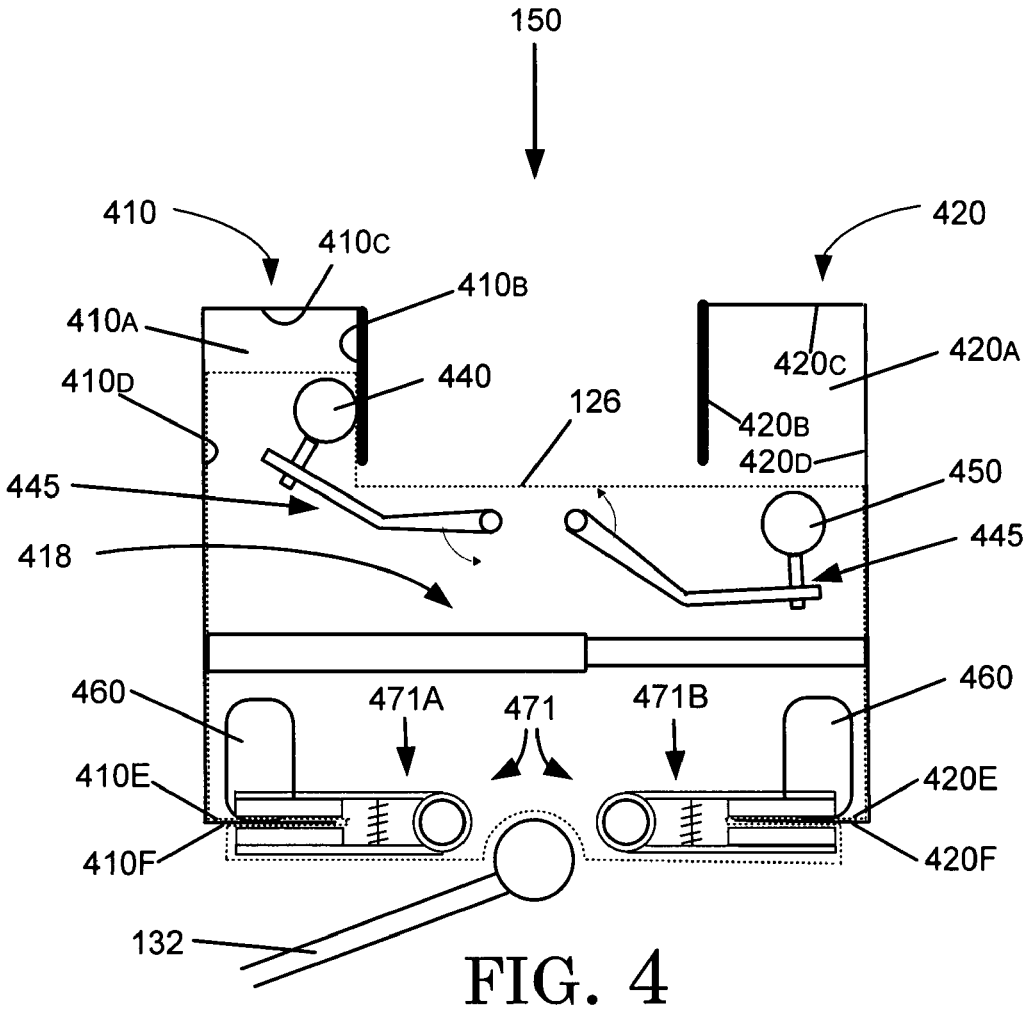
FIG. 4 portrays a rear view diagram of an embodiment of a roadway guideway and an embodiment of an apparatus for coupling the roadway guideway to a vehicle, the apparatus including an illustrative braking system.

Further, in an embodiment, the apparatus 120 includes a braking system (not shown) to brake the movement of the apparatus 120 along the roadway guideway 150. FIG. 4 includes a portrayal of an embodiment of the braking system.

Referring now to FIG. 4, there is portrayed a rear view of an embodiment of roadway guideway 150, and a head unit 126 operative to physically couple to the roadway guideway 150.

Selected segments of the exemplary roadway guideway 150 have multiple longitudinally disposed sections for physically coupling a component of the apparatus 120 to the roadway guideway 150, illustratively portrayed as a first guideway section 410, and a second guideway section 420. The first guideway section 410 includes a first coupling chamber (or pocket or the like) 410A, and the surfaces 410B, 410C, and 410D. The second guideway section 420 includes a second coupling chamber (or pocket or the like) 420A, and the surfaces 420B, 420C, and 420D. Each coupling chamber 410A and 420A in operation of the apparatus 120 is configured to separately physically couple a component of the apparatus 120 (FIG. 1). As described presently with reference to FIG. 8, and FIGS. 11A and 11B, in operation of the roadway guideway 150, each section 410 and 420 is independent and may separate from its proximate position as portrayed in FIG. 4 to allow the apparatus 120 to physically couple to one longitudinally disposed section or the other, and thereby to follow one route or the other.

In the portrayed embodiment, the apparatus 120 includes multiple separate coupling components to separately physically couple the apparatus 120 to the portrayed coupling structures. The coupling components are illustratively a first coupling component structure 440, and a second coupling component structure 450. Each coupling component structure is operative to physically couple to a specific longitudinally disposed guideway section, and may be spaced longitudinally along a head unit 126. The first coupling component structure 440 is configurable to physically couple to the surface 410B and the wall of which it is a surface of the first coupling chamber 410, and the second coupling component structure 450 is configurable to physically couple to the surface 420B and the wall of which it is a surface of the second coupling chamber 420, so that the apparatus 120 is configurable to physically couple to the roadway guideway 150.

The first coupling component structure 440 and the second coupling component structure 450, are each switchable to physically couple or to not physically couple to its respective roadway guideway section. The first coupling component structure 440 is configurable to physically couple to the first guideway section 410 when the first coupling component structure 440 is switched (enabled) to couple to the first guideway section 410, and configurable to not couple to the first guideway section 410 when the first coupling component structure 440 is not switched (disenabled) to couple to the first guideway section 410. In the portrayed embodiment, the first coupling component structure 440 is illustratively portrayed as enabled to couple to the first guideway section 410 by being deployed within the first coupling chamber 410A so that it is laterally constrained within the first coupling chamber 410. The second coupling component structure 450 is configurable to physically couple to the second guideway section 420 when the second coupling component structure 450 is switched (enabled) to couple to the second guideway section 420, and configurable to not couple to the second guideway section 420 when the second coupling component structure 450 is not switched (disenabled) to couple to the second guideway section 420. In the portrayed embodiment, the second coupling component structure 450 is illustratively portrayed as disenabled by being deployed outside, i.e. not within, the second coupling chamber 420 so that it is not laterally constrained within the second coupling chamber 420.

In an embodiment in which each coupling component (such as coupling component structure 440 and coupling component structure 450) comprises an element positioned in a chamber (or pocket or the like), so that in operation the element is physically constrained within the chamber, the coupling structure may include rotatable cylinder (such as a resilient wheel) so that it may roll along a surface of the chamber (or pocket) when it contacts the surface as the apparatus 120 moves along the roadway guideway 150. In an embodiment in which each coupling component (such as coupling component structure 440 and coupling component structure 450) comprises an element positioned in a chamber, the coupling structure may include a bearing disposed on its surface. The bearing is to reduce friction that may be caused by contact with a surface of the chamber when the apparatus 120 moves along the roadway guideway 150. Illustrative embodiments of the bearing may include a roller bearing, a bearing material, or an air bearing. In an embodiment, the chamber may instead or additionally include a bearing disposed on its surface. In operation, the apparatus coupling component structures and/or the guideway coupling structures may receive an application of a lubricant.

In the portrayed embodiment, the apparatus 120 illustratively includes a coupling enabling structure 445 to enable, and disenable, the coupling components physically coupling to, and not physically coupling to, a coupling structure, or a section of the roadway guideway 150. In the portrayed embodiment, the coupling enabling structure 445 illustratively is configured to physically couple or to physically decouple the coupling component structure 440 or 450 by moving the coupling component structure 440 or 450 into or out of the coupling chamber 410 or 420. In an embodiment (not shown) the coupling component structure 440 may comprise a shaft-like structure joined to a crank at each end, each crank at approximately $\pi$ radians apart on the circumference of the shaft. One crank is joined to the coupling component 450, and the other crank is joined to the coupling component 450, so that in a rotation of the shaft about its longitudinal axis, the first coupling component structure 440 and the second coupling component structure 450 are separately deployable, and deployable only one at a time, in its respective coupling chamber. In an embodiment in which multiple coupling components are configurable to physically couple or not to physically couple to a specific guideway coupling structure, each coupling structure may be configured to deploy or to not deploy together.

Moreover, the coupling enabling structure may include a structure to switch the first coupling component structure 440 to physically couple and/or physically decouple to the first section 410 of the roadway guideway 150, and to switch the second coupling component structure 450 to physically couple and/or physically decouple to the second portion 420 of the roadway guideway 150. In an embodiment, the coupling structure moreover may include a circuit (not shown) to transmit an indication of a commanded coupling structure enablement or disenablement. In an embodiment, the coupling structure may include a user interface (not shown) to generate the indication of the commanded coupling structure enablement from a user input. In an embodiment, the coupling component structures are configured to deploy or not to deploy (or otherwise physically couple) based upon receiving a signal indicating whether the coupling component structure is to physically couple or to not to physically couple. In an embodiment, the user interface may be disposed within the roadway vehicle 180 (FIG. 1), and the apparatus 120 may include an interface to couple the user interface to the circuit in a transmission-reception communication relationship.

It is specifically understood that multiple embodiments of coupling components may be used, as well as multiple embodiments of the separate longitudinally disposed roadway guideway sections. For instance, a particular mechanical coupling structure embodiment has been described herein but it is specifically understood that other coupling structure embodiments, such as magnetic coupling structure embodiments and hydraulic coupling structure embodiments may be a component of the apparatus 120 and the roadway guideway 150. It is specifically understood that while two horizontally opposed longitudinally disposed guideway coupling sections have been portrayed with reference to FIG. 4, and will be portrayed as well with reference to FIGS. 5, 7, and 8, in embodiments there may two vertically and/or horizontally opposed sets or positions of longitudinally disposed guideway coupling sections, each set or position comprising one or more separate guideway coupling structures, each separate guideway coupling structure associated with a specific coupling component configurable to physically couple the apparatus 120 to the separate guideway coupling structure, and configured to physically couple or not physically couple together to the apparatus 120.

The apparatus 120 may further include a structure to vertically couple or support the apparatus 120 on the roadway guideway 150, and/or a section of the roadway guideway 150. In an embodiment, the structure to vertically couple the apparatus 120 to the roadway guideway 150 or a section thereof may comprise a rotatable cylinder 460 to vertically couple or support the apparatus 120 to/on the roadway guideway 150, and to roll on the roadway guideway 150 as the apparatus 120 moves along the roadway guideway 150. In an embodiment, the rotatable cylinder may comprise a tire like-structure, or other cylinder having a somewhat resilient surface to cushion the apparatus 120 on the roadway guideway 150 or a section thereof. In another embodiment, the structure to vertically couple the apparatus 120 to the roadway guideway 150 may illustratively comprise a bearing, such as an air bearing to ride above a surface of the roadway guideway while the apparatus 120 is translating on the roadway guideway 150 or a longitudinally disposed roadway guideway section.

In an embodiment, the apparatus 120 includes an illustrative braking system (herein also termed the brakes) to decelerate and/or to stop the head unit 126 from moving along the roadway guideway 150 (or a longitudinally disposed section thereof, a roadway guideway structure, and the like). In an embodiment, the braking system is configured to stabilize the head unit 126 against moments occurring during a stop.

The braking system includes an illustrative braking structure 471 operative to press against a surface(s) of the roadway guideway 150, the surfaces here portrayed as the surface 410E, the surface 410F, the surface 420E, and the surface 420F. The surface 410E and the surface 410F are components of the first longitudinally disposed section 410, and the surface 420E and the surface 420F are components of the second longitudinally disposed section 420. The braking structure 471 includes two separate braking structures 471A and 471B, each operative to press against a surface of a distinct longitudinally disposed guideway section 410 or 420, here the respective surfaces 410E and 410F of the longitudinally disposed section 410, and the respective surfaces 420E and 420F of the longitudinally disposed section 420.

The braking structure 471A has a friction material to contact the surfaces 410E and 410F. The braking structure 471B has a friction material to contact the surfaces 420E and 420F. If the brakes are applied to a surface, the brakes generate a frictional force to decelerate and/or to stop the apparatus 120 from translating along the guideway 150, as well as decelerate/stop a vehicle 180 that is coupled to the apparatus 120. In an embodiment, the surfaces to be contacted by the braking structures 471A and/or 471B have a frictional surface. In an embodiment, the braking system includes a structure to position the brake structures 471A 471B to press and to not press against the respective surfaces 410E and 410F, or 420E and 420F of the guideway 150.

The portrayed brake structures 471A and 471B are illustratively embodied as U-shaped clamping devices, commonly termed calipers, each clamping device configured to straddle the surfaces 410E 410F or 420E 420F and, when actuated, to press against the surfaces 410E 410F or 420E 420F (depending upon the clamping device) to generate friction to stop the apparatus 120 and a coupled vehicle 180. In an embodiment, it is understood that the coefficient of friction of the friction material, the coefficient of friction of the surfaces of the roadway guideway to which the frictional material are to contact, the extent of the friction material to press against the surface of the guideway structure, and the extent of the pressing force that the braking structures are configured to generate are such that a strong enough frictional force is generated upon application of the brakes to stop the apparatus 120 and the coupled vehicle 180 from moving at cruise speeds within the available head space.

Although one specific embodiment of the braking system has been described, it is specifically understood that innumerable embodiments of the braking system are within the scope of the invention. For instance, it is understood that the braking structure 471 may be embodied by other structures and systems configured to decelerate the vehicle by a command thereto, by selectively pressing against a surface of the guideway structure, or not pressing against the surface of the guideway structure. Illustrative embodiments may include mechanical structures, electromagnetic structures, hydraulic structures, and gas structures (such as high gas pressure systems or approximate vacuum systems). And moreover, it is specifically understood that in embodiments, the un-actuated position of the braking structures may be in a position to press against a guideway surface, and the actuating structure is configured to release the braking structure from pressing against the surface, and in embodiments the un-actuated position may be in a position to not press against a guideway surface, when the actuating structure is configured to actuate the braking structure to press against the surface. And moreover, although the portrayed embodiment describes a braking structure to selectively press against two surfaces, a top surface and a bottom surface, of a guideway structure; in embodiments the braking structure may be configured to selectively press against a number of surfaces other than two of a guideway structure, such as against only one surface of a guideway structure, or more than two surfaces of a guideway structure, for any number of guideway structures for any number of longitudinally disposed sections of a roadway guideway. Moreover, in an embodiment, the braking system may include any number of braking structures.

The portrayed apparatus 120 moreover includes an embodiment a force generation unit 418. The portrayed components of the force generation unit 418 are configured to include a propulsive cylinder to make contact with each longitudinally disposed guideway section, so that the force generation unit 418 is operative to translate the apparatus 120 along each longitudinally disposed guideway section.

It is specifically understood that, as described with reference to FIG. 3, the head unit 126 of the apparatus 120 may include additional structures than those portrayed with reference to FIG. 4. Moreover, the head unit 126 may include additional structures to position the elements of the head unit 120 in relationship to one another and the roadway guideway 150. The head unit 126 is portrayed here as including the force generation unit 418, the first coupling component structure 440, the second coupling component structure 450, the coupling enabling structure 445, the braking structure 471, and the structure to vertically couple the apparatus 120, illustratively the rotatable cylinder 460. The head unit 126 is therefore represented by elements included within a dashed line labeled 126 and roughly encompassing these structures.

In an embodiment, the coupling component structures 440 and 450 are to be disposed approximately at or forward of the vertical coupling structures 460 and the elements of the force generation unit 418 components operative to react with the roadway guideway 150, so that as a coupling structure moves along a specific section of the roadway guideway 150 at an intersection or the like as described with reference to FIG. 8, and with reference to FIGS. 11A and 11B, the vertical coupling structures and the elements of the force generation unit 418 that react with the roadway guideway 150 will react with the longitudinally disposed section that the coupling structure is moving along. In an embodiment, the apparatus 120 may include more than one pair of coupling component structures 440 and 450, arranged longitudinally across the head unit 126. In such an embodiment, the forwardly disposed coupling component structures pair are to be disposed approximately at or forward of the vertical coupling structures 440 and 450 and the elements of the force generation unit 418, and in an embodiment, an aft coupling component 440 450 pair may be disposed aft of the vertical coupling structures. Each coupling component structure that is configurable to physically couple to a specific longitudinally disposed section of the guideway are to be operatively switched to physically couple or not to physically couple to the specific longitudinally disposed guideway at an approximate instant in time. In an embodiment, each coupling component structure to couple to a specific longitudinally disposed guideway section is configured to switch together to a coupling state, or to a non-coupling state.

In embodiments in which the head unit 126 relies upon vertical support provided by a vertical coupling component that may create a non-symmetric vertical moment about the center of gravity of the head unit 126, such as in the operational configuration in which the head unit 126 is in a transition region as described with reference to FIG. 8, and so is being non-symmetrically supported by one longitudinally disposed guideway, the guideway section and the head unit 126 are configured to support the apparatus 120 without the head unit 126 appreciably tipping downward such that the power generation unit 318 or 418 would not operatively couple to the roadway guideway 150, or some other coupling component would not adequately couple to the guideway section.

Illustratively, with reference to the portrayed embodiment, the space between a coupling component 440 disposed within the coupling chamber 410A, and the interior surfaces of the first coupling chamber 410A of the longitudinally disposed section 410 are such that the power generation unit 418 does not tip out of operational position when the apparatus 120 is supported by the coupling component 440 contacting the coupling component 490 on the surface 410E. This can be illustratively configured by limiting the horizontal space between the coupling component 440 and the surfaces of the first coupling chamber 410A to diminish the enabled tip angle of the coupling component within the first coupling chamber 410. In another illustrative embodiment as portrayed in FIG. 4, the coupling enabling structure 445 causes the coupling component 440 to contact the surface 410B, In an embodiment, the coupling component structure forms a cantilever to support the remainder of the head unit 126 in a functioning horizontal orientation. In an embodiment portrayed with respect to FIG. 7, the coupling component is embodied as a wedge to contact, and in an embodiment contact adjustably, a surface of a coupling chamber (or pocket). The wall of the section 410 having as a surface the surface 410B is configured to be strong enough to support the head unit 126 when the coupling component 440 contacts the surface 410B. The wall is therefore portrayed as being thicker, to represent adequate strength as necessary, in FIG. 4. Similarly, the wall of the surface 420B of the section 420 is configured to also be strong enough to support the head unit 126 when the coupling component 450 contacts the surface 420B and is therefore portrayed as being thicker to represent the additional strength as necessary.

Figure 5:
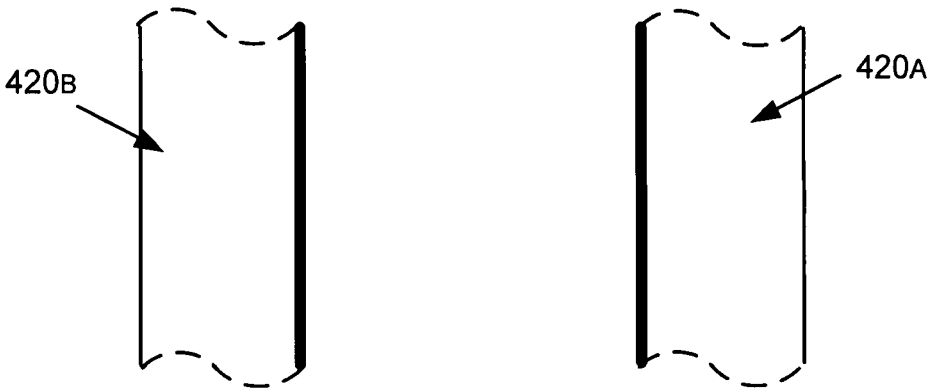
FIG. 5 portrays a top view diagram of an embodiment of the roadway guideway portrayed in FIG. 4.
Figure 7:
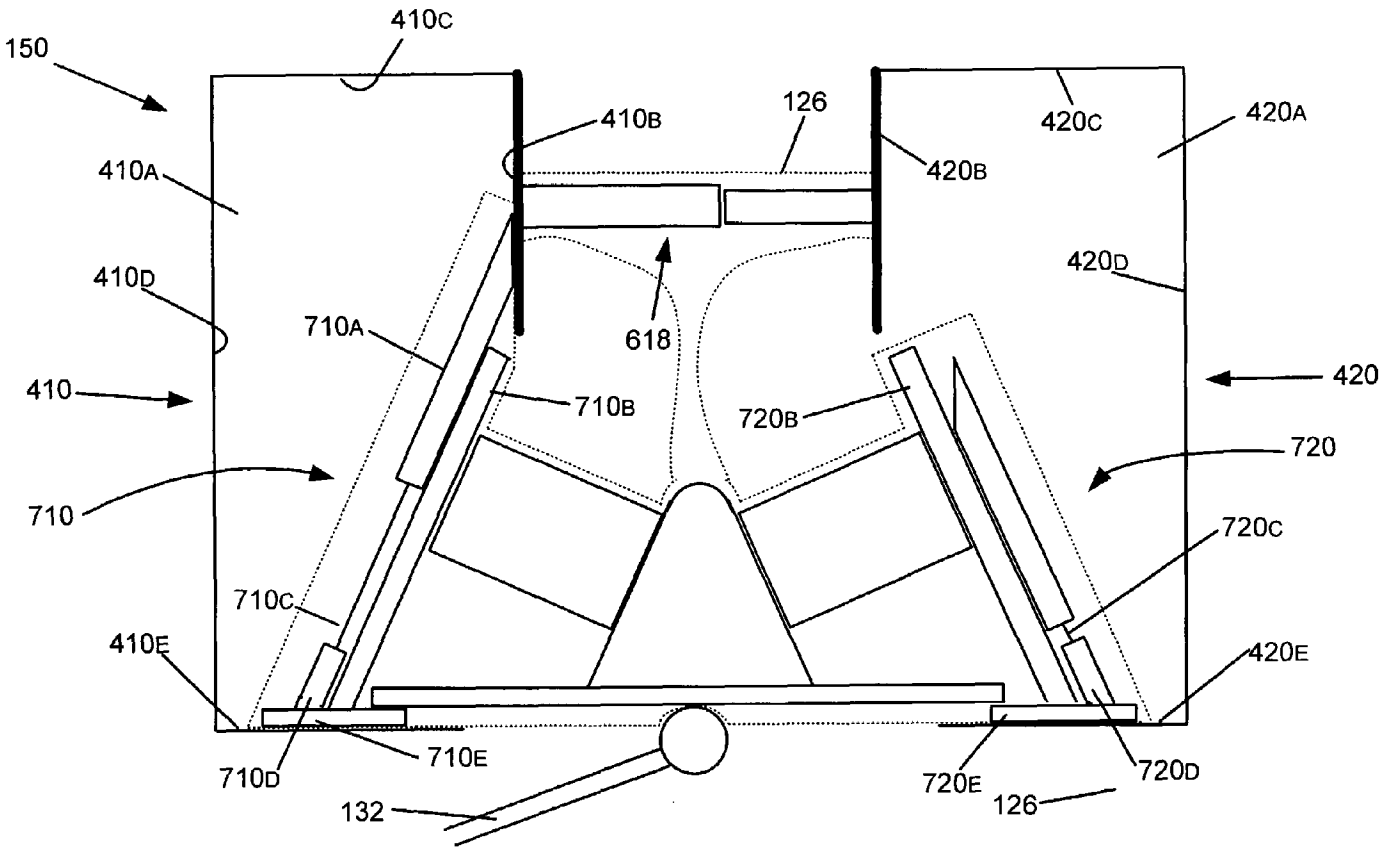
FIG. 7 portrays a rear view diagram of another embodiment of a roadway guideway and an embodiment of an apparatus for coupling the roadway guideway to a vehicle.

Referring now to FIG. 5, there is portrayed a top view diagram of an embodiment of a portion of the roadway guideway 150 portrayed in FIG. 4 (and to be portrayed in FIG. 7). The roadway guideway 150 comprises multiple separate guideway sections; here portrayed as two sections each having one chamber (or pocket), a first coupling chamber 410A and a second coupling chamber 420A. It is specifically understood that as described with reference to FIG. 3, the roadway guideway 150 may have in embodiments additional structures, such as a horizontal surface, illustratively the horizontal surfaces 361 (FIG. 3) that may be operative to vertically support the apparatus 120 on the roadway guideway 150, and a vertical surface, such as the vertical surfaces 317 (FIG. 3) that may be operative to horizontally support the apparatus 120 on the roadway guideway 150.

In the portrayed embodiment, the guideway coupling structures, illustratively the coupling chambers 410A and 420A, are horizontally disposed with respect to one another. However in another embodiment, the guideway sections and/or coupling structures may be vertically disposed with respect to one another, or vertically and horizontally disposed with respect to one another. The disposition of the guideway sections and coupling structures with respect to one another are moreover described with reference to FIG. 8.

Referring again to FIG. 1, and to FIG. 4, in response to an application of the brakes on an apparatus 120 translating along the guideway 150, the apparatus 120 is subjected to a braking force. The braking force is passed through the apparatus 120 to the coupled vehicle 180, and in reaction the vehicle 180 may impose a strong opposing force to the apparatus 120. The opposing force may be imposed upon the vehicle coupling structure 128 and upon the head unit 126. Moreover, when the vehicle is laterally offset from the centerline of the guideway 150 (e.g. position E, FIG. 9), braking produces a moment or torque in attempting to rotate the apparatus 120 away from the vehicle 180. The opposing force and torque communicated into the head unit 126 may tend to raise the apparatus 120, to pitch the apparatus 120 up within the guideway 150, and/or to yaw the apparatus 120 within the guideway 150.

Figure 6:
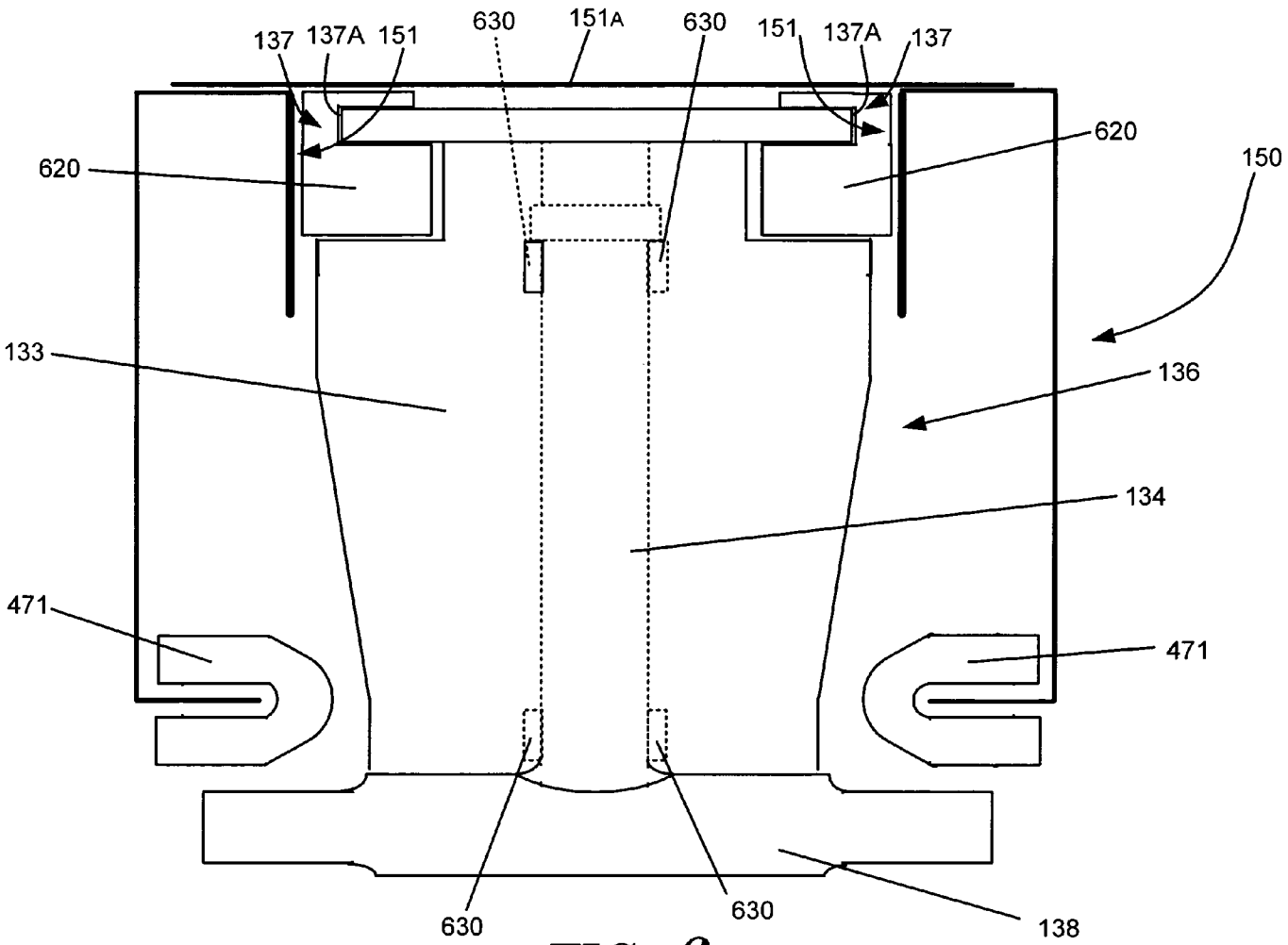
FIG. 6, portrays a rear view diagram of an embodiment of a roadway guideway and a coupled apparatus for coupling the roadway guideway to a vehicle, the guideway and/or apparatus configured so the apparatus is constrained to have limited potential to pitch, yaw, and/or ascend within the guideway.

In an embodiment, the head unit 126 or other component of the apparatus 120, such as the joint 136, are configured to constrain the apparatus 120 in a limited range of pitch, yaw, and/or ascent within the guideway 150. Referring now to FIG. 6, there is portrayed an illustrative embodiment in which specific surfaces 137 of the joint 136 are disposed near facing surfaces 151 of the guideway 150. The surfaces 151 of the guideway 150 may include a covering 151A. Sliders 620 are interposed between the surfaces 137 and the surfaces 151. The sliders 620 may be attached to the joint 136 such as by a vertically disposed pin, to maintain the position of the sliders 620 relative to the joint 136. In an embodiment, the surfaces 137 include a surface 137A having a vertical component, and the surfaces 151 include a surface having a vertical component that is opposed to the surface 137A to limit the lateral and yawing movement of the joint 136 within the guideway 150. In an embodiment, the surfaces 137 include a surface having a horizontal component, and the surfaces 151 include a surface having a horizontal component that is opposed to the surface 137 having a horizontal component, to limit the vertical and pitching movement of the joint 136 within the guideway 150. In an embodiment, the slider 620 includes a bearing surface to lower the frictional resistance of the guideway 150 and joint 136 along the slider 620. Moreover, in an embodiment, the brake structure 471 which may be disposed aft of the surfaces 137 is configured to further limit the rising up and pitching of the apparatus 120 within the guideway 150. The sliders 620 and the brakes structure 471 are operative to together hold the apparatus 120 longitudinally aligned with the guideway 150. In the portrayed embodiment, the joint 136 illustratively includes a trunnion 138 to rotatably support the vehicle coupling structure 128 (FIG. 1), such as the member 132 (FIG. 1), on the joint 136. And in an embodiment, the joint 136 includes a sleeve, 133 and a rotatable axle 134 positioned within the sleeve 133 to rotatably support the trunnion 138. Included but not shown are motors and brakes to rotate the steerable trunnion 138 to position and/or to hold the azimuth orientation of the trunnion and the member 132, referred to illustratively as the vehicle coupling structure positioning unit with reference to FIG. 1.

Referring to FIG. 7, there is portrayed a rear view of another embodiment of a roadway guideway 150, and a head unit 126 operative to couple to the roadway guideway 150. As described with reference to FIG. 4, an embodiment of a roadway guideway 150 includes separate illustrative longitudinally disposed sections, a first guideway section 410, and a second guideway section 420. Each section has illustratively one guideway coupling chamber. The sections are positioned horizontally. The first guideway section 410 has an embodiment of a first coupling chamber (or pocket) 410A and the surfaces 410B, 410C, 410D, and 410E. The second guideway section 420 has an embodiment of a second coupling chamber (or pocket) 420A and the surfaces 420B, 420C, 420D, and 420E. Each coupling chamber 410A and 420A, in operation of the apparatus 120, is configured to separately physically couple a component of the apparatus 120 (FIG. 1). And as described with reference to FIG. 4, each section 410 or 420 may converge or diverge to or from its complementary other section 420 or 410 as portrayed in FIG. 4, to allow the apparatus 120 to follow one route or another, depending upon the roadway guideway section to which the apparatus 120 is physically coupled. In this way, exit and entry are accomplished using the geometry of FIG. 8.

A first coupling component structure 710 is configurable to physically couple to the first coupling chamber 410. The embodiment of the first coupling component structure 710 includes a first wedging component 710A. The first wedging component 710A is configured to move along an angled structure 710B of the first coupling component structure 710, into or out of a coupling position. The shape and the movement of the first wedging component 710A is such that in the coupling position, as portrayed in FIG. 7, a surface of the first wedging 710A is proximate to a surface of the first coupling chamber 410A in the coupling disposition, here the surface 410B, and supported against the surface 410B by an angled device 710C. The first wedging 710A in the coupling position because of its position against the proximate surface 410B, is operative to wedge against the surface 410B to which it is proximate, preventing most if not all downward (illustratively clockwise) tipping of the head unit 120 when the first coupling component structure 710 is in the coupling position. In the uncoupled position, the first wedging component 710A is disposed out of the first coupling chamber 410, so that it does not contact either of the opposed surfaces 410B and 410D that form the first coupling chamber 410A. The first coupling component structure 710 moreover includes a first actuating mechanism 710D to move the first wedging component 710A via the angled device 710C into or out of coupling position. The actuating mechanism may be of the variable stroke type to enable adjustment, under system or module control.

Similarly, a second coupling component structure 720 is configurable to physically couple to the second coupling chamber 420. An embodiment of the second coupling component structure 720 includes a second wedging component 720A. The second wedging component 720A is configured to move along an angled structure 720B of the second coupling component structure 720, into or out of a coupling position. The shape and the movement of the second wedging component 720A is such that in the coupling position, a surface of the second wedging 720A is proximate to a surface of the second coupling chamber 420A in the coupling disposition, here the surface 420B, and supported against the surface 420B by an angled device 720C. The second wedging 720A in the coupling position because of its position against the proximate surface 420B, is operative to wedge against the surface 420B to which it is proximate, preventing most if not all downward (illustratively clockwise) tipping of the head unit 120 when the second coupling component structure 720 is in the coupling position. In the uncoupled position, as portrayed in FIG. 7, the second wedging component 720A is disposed out of the second coupling chamber 420, so that it does not contact either of the opposed surfaces 420B and 420D that form the second coupling chamber 420A. The second coupling component structure 720 moreover includes a second actuating mechanism 720D to move the second wedging component 720A via the angled device 720C into or out of coupling position. The actuating mechanism may be of the variable stroke type to enable adjustment, under system or module control.

The apparatus 120 may further include a structure to vertically couple or support the apparatus 120 on the roadway guideway 150. In an embodiment, as described with reference of FIG. 3, the structure to vertically couple or support the apparatus 120 on the roadway guideway 150 may also provide lateral support to the apparatus 120 on the roadway guideway 150. In an embodiment, the structure to vertically couple the apparatus 120 to the roadway guideway 150 may comprise an air bearing 710E 720E to vertically couple or support the apparatus 120 to/on the roadway guideway 150 and move along the roadway guideway 150 as the apparatus 120 moves along the roadway guideway 150 and/or a guideway section. The portrayed apparatus 120 moreover includes an embodiment of a force generation unit 718, an embodiment of which was described with reference to FIG. 3.

The portrayed components of the force generation unit 718 are configured to include a propulsive cylinder to make contact with each longitudinally disposed guideway section, so that the force generation unit 718 is operative to translate the apparatus 120 along each longitudinally disposed guideway section. In the portrayed embodiment, each propulsive cylinder is operative to make contact with an outer wall of a longitudinally disposed guideway section while in the embodiment portrayed with reference to FIG. 4, each propulsive cylinder is operative to make contact with an inner wall of a longitudinally disposed guideway section.

It is specifically understood that as described with reference to FIG. 4, the head unit 126 of the apparatus 120 may have additional structures than those portrayed with reference to FIG. 7. Moreover, the head unit 126 may have additional structures to position the elements of the head unit 120 in relationship to one another and the roadway guideway 150. The head unit 126 is therefore represented by elements included within a dashed line labeled 126 roughly encompassing these structures. Although a braking system is not shown in FIG. 7, it is specifically understood that the head unit 126 may include a braking system configured to contact a surface of each longitudinally disposed guideway section 410 and 420 to decelerate and/or to stop the head unit 126 moving along the guideway 150. An illustrative embodiment of such a braking system has been portrayed in FIG. 4, and described with reference to FIG. 4.

Figure 8:
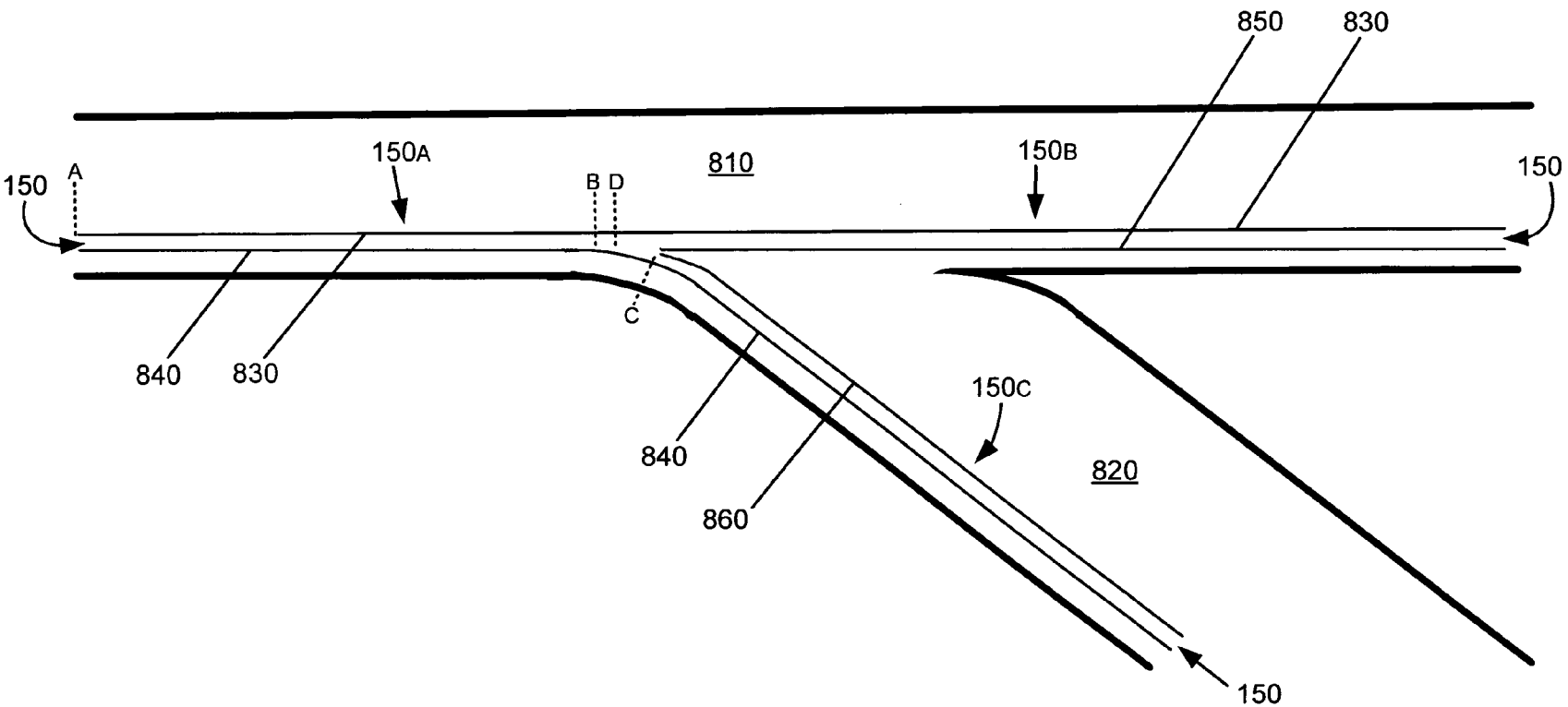
FIG. 8 portrays a top view diagram of an embodiment of a roadway and an intersecting alternative vehicle route, the route illustratively configured as a roadway exit or entry ramp, and an embodiment of a roadway guideway disposed along the roadway and along the roadway ramp.

Referring now to FIG. 8, these is portrayed a diagram of an embodiment of a portion of a vehicle roadway 800 with a disposed roadway guideway 150. The vehicle roadway 800 illustratively includes a roadway 810 and an exit ramp 820, or some other vehicle route alternative to the roadway 810, that a roadway vehicle may enter or exit from or to the roadway 810 while being transported by the transportation system 100 (FIG. 1).

Along the roadway 810 and the roadway guideway exit ramp 820 is disposed a roadway guideway 150. The placement of a roadway guideway 150 relative to a roadway is described further presently with respect to FIG. 9. The roadway guideway 150 is categorized by three illustrative portions as described below, a roadway guideway portion 150A, a roadway guideway portion 150B, and a roadway guideway portion 150C.

Describing the roadway guideway 150 from the left hand side of the FIG. 8, marked with the reference character "A", to a region of transition of the roadway 810 to the roadway exit ramp 820, marked with a reference character "B", the roadway guideway 150 follows the direction of the roadway 810. This illustrative portion of the roadway guideway 150 is termed herein the roadway guideway portion 150A. Here, the roadway guideway portion 150A comprises multiple horizontally arranged sections disposed longitudinally along a roadway guideway, illustratively embodied as the two guideway coupling structures 410 420 described with reference to FIGS. 4, 5, and 7, the coupling chamber 830 and the coupling chamber 840. The coupling chambers 830 and 840 (or longitudinally disposed guideway sections) are illustratively positioned horizontally with respect to one another.

Moreover, beginning at the reference character "D", the roadway guideway 150 follows the direction of the roadway 510. This illustrative portion of the roadway guideway 150 is termed herein the roadway guideway portion 150B. Here, beginning at the reference character "D", the roadway guideway portion 150B comprises multiple horizontally arranged sections that are disposed longitudinally along a roadway guideway, illustratively embodied as the two guideway coupling structures 410 420 described with reference to FIGS. 4, 5, and 7, the coupling chamber 830 and the coupling chamber 850. The coupling chambers 830 and 850 (or longitudinally disposed guideway sections) are illustratively positioned horizontally with respect to one another.

And moreover, beginning at the reference character "B", the roadway guideway 150 follows the direction of the roadway exit ramp 820. This illustrative portion of the roadway guideway 150 is termed herein the roadway guideway portion 150C. Here, the roadway guideway portion 150C comprises multiple horizontally arranged sections disposed longitudinally along a roadway guideway, illustratively embodied as the two guideway coupling structures 410 420 described with reference to FIGS. 4, 5, and 7, the coupling chamber 840 and the coupling chamber 860. The coupling chamber 840 has a curvature as it changes from being disposed alongside the roadway 810 to being disposed alongside the roadway exit ramp 820. The coupling chambers 840 and 860 (or longitudinally disposed guideway sections) are illustratively positioned horizontally with respect to one another.

The guideway 150 is operative to be physically coupled to an apparatus 120 as illustratively portrayed with reference to FIGS. 1, 3, 4, 5, and 7, with a separate coupling component physically coupling the apparatus 120 to each of the sections (or guideway coupling structures). Illustratively, for guideway coupling structures that are embodied as the coupling chambers 410 and 420, the coupling component structures may illustratively comprise the embodiments portrayed with reference to FIGS. 3, 4, and 7; the coupling component structures 310, 311, 312, and 313 portrayed with reference to FIG. 3, the coupling component structures 440 and 450 portrayed with reference to FIG. 5, and/or the coupling component structures 710 and 720 portrayed with respect to FIG. 7.

In operation of the apparatus 120 moving along the roadway guideway 150, a mode of operation may include moving from one roadway to another roadway, such as moving from along the roadway 810 to along the roadway exit ramp 820. In this operation, the apparatus 120 is initially physically coupled to the roadway guideway portion 150A as it moves along the roadway 810, and is then physically coupled to the roadway guideway portion 150C as it then moves along the roadway exit ramp 820. Moving along the roadway guideway portion 150A, a first coupling component structure is physically coupled to the coupling chamber 830 and/or a second coupling component structure is horizontally coupled to the coupling chamber 840. However, as the head unit 126 approaches the reference character "B" along the roadway guideway portion 150A before the first coupling component structure passes the reference character "B", the first coupling component structure is switched to deploy out of the coupling chamber 830 if it was in the coupling chamber 830, and the second coupling component structure is switched to deploy into the coupling chamber 840 if it was not already in the coupling chamber 840, so that only the second coupling component structure is physically coupled to the roadway guideway portion 150A, being coupled to the section and coupling structure 840. With only the second coupling component structure coupled to the coupling structure 840, the second coupling component structure will move along the coupling chamber 540 past the reference character "B" onto the roadway guideway section 150C. After the first coupling component structure has passed the reference character "C", the first coupling component structure may be switched to deploy into the coupling chamber 860 of the roadway guideway portion 150C. It is specifically noted that the reference character "C" while portrayed here as beginning beyond the coupling chamber 850, in an embodiment may begin before the coupling chamber 850. These relative positions are merely illustrative, and may additionally illustratively depend upon whether they are in horizontal or in vertical position with respect to one another. In the configuration of the portrayed embodiment of the roadway guideway 150, there is a break between the section and coupling chamber 840, and section and the coupling chamber 850, so that a portion of the head 126 that includes the first coupling component structure may pass through the break and move along the roadway guideway portion 150C without contacting the coupling chamber 850. It is assumed that the roadway guideway in the proximity of the break is disposed above the level of a roadway vehicle, so that the roadway vehicle will pass under the coupling chamber (or guideway section) 850 in moving to the roadway 820. Moreover, in an embodiment, the coupling chamber (or guideway section) 860 may have a ramp to pick up a head unit that may have some tilt.

In operation of the apparatus 120 moving along the roadway guideway 150, a mode of operation may include moving along a roadway through an intersection, such as moving along the roadway 810 through the portrayed intersection for that roadway exit ramp 820. In this operation, the apparatus is initially physically coupled to the roadway guideway portion 150A as it moves along the roadway 810, and is then physically coupled to the roadway guideway portion 150C as it continues to move along the roadway 810. Moving along the roadway guideway portion 150A, the first coupling component structure is physically coupled to the coupling chamber 830 and/or the second coupling component structure is physically coupled to the coupling chamber 840. However, as the head 126 approaches the reference character "B" along the roadway guideway portion 150A before the second coupling component passes the reference character "B", the second coupling component structure is switched to deploy out of the section and coupling chamber 840 if it was in the section and coupling chamber 530, and the first coupling component structure 340 is switched to deploy in the section and coupling chamber 540 if it was not already in the section and coupling chamber 540, so that only the first coupling component structure 350 is physically coupled to the roadway guideway portion 150A, being coupled to the section an decoupling structure 830. With only the first coupling component structure coupled to the section and coupling structure 830, the first coupling component structure will move along the section and coupling chamber 830 past the reference character "B" onto the roadway guideway portion 150B. After the second coupling component structure has passed the reference character "D", the second coupling component structure may be deployed in the section and coupling chamber 850 of the roadway guideway portion 150B. In the illustrative configuration of the roadway guideway 150, there is a break between the coupling chamber 860 and the coupling chamber 830, so that a portion of the head 126 that includes the second coupling component structure may pass through the break and move along the roadway guideway section 150B without contacting the section and coupling chamber 860. In an embodiment, the coupling chamber (or guideway section) 850 may have a ramp to pick up a head unit that may have some tilt.

As described with reference to FIGS. 3, 4, 5, and 7, the guideway coupling structures (or guideway sections) of the roadway guideway 150 may be vertically disposed with respect to each another, rather than or in addition to being horizontally disposed with respect to one another as in the portrayed embodiment. Illustratively, the coupling chambers 830 and 840 (and guideway sections) may be vertically disposed with respect to one another rather than being horizontally disposed as portrayed in FIG. 5. In an embodiment in which the coupling chambers of the roadway guideway have a vertical disposition with respect to one another, the coupling structures of the apparatus 120 that are configured to physically couple to these coupling structures may be vertically disposed with respect to one another. In such a configuration, the break in a coupling chamber may be of a shorter distance than if the coupling chambers are horizontally disposed because the width of the apparatus 120 does not have to clear a coupling chamber when transitioning form one roadway section to another.

Figure 9:
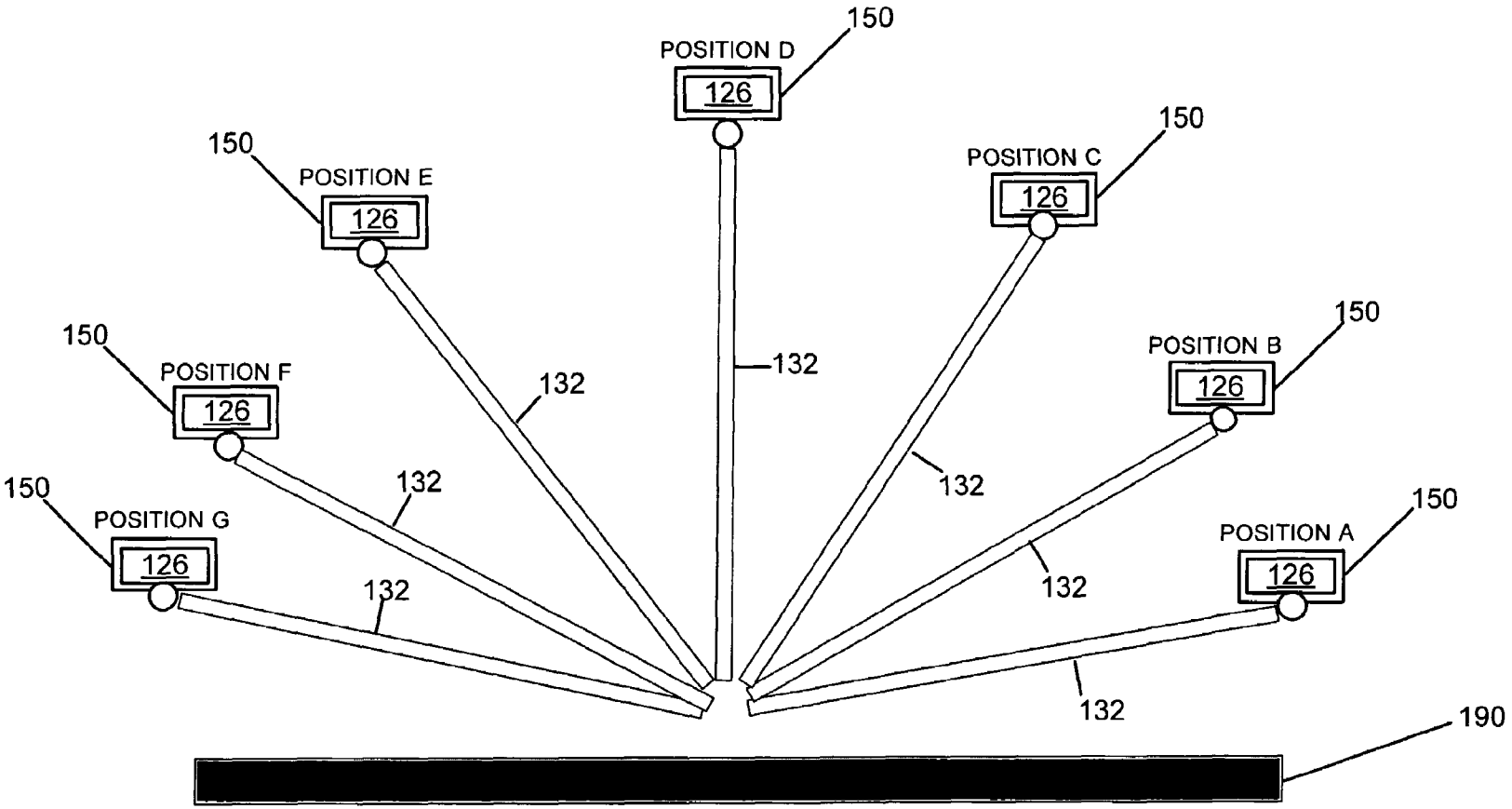
FIG. 9 portrays a rear view diagram of illustrative alternate or successive positions of an embodiment of a roadway guideway relative to a vehicle roadway, and an illustrative member to approximately span the distance from a head unit to the roadway vehicle.

Referring now to FIG. 9, a roadway guideway 150 (or a roadway guideway structure) is operatively disposed along a roadway 190 such that an apparatus 120, including the member 132, may couple the roadway guideway 150 (or a roadway guideway structure) to a vehicle (not shown) on the roadway 190. Operatively, embodiments of the roadway guideway 150 (or a roadway guideway structure) may be disposed in multiple positions with respect to a roadway 190 and with respect to a coupled roadway vehicle. In an embodiment, the roadway guideway 150 is configurable to have a range of vertical displacement with respect to the surface of the roadway 190 and/or a range of horizontal displacement with respect to the surface of the roadway 190.

Illustratively in an embodiment, the roadway guideway 150 may be in a relatively low position relative to the roadway 180, and disposed more to one side of the roadway 190, as exemplified by the position A of the roadway guideway 150. And illustratively in an embodiment, the roadway guideway 150 may be in a high position relative to the roadway 190 and disposed less to one side of the roadway 190, as exemplified by the position C of the roadway guideway 150. And illustratively in an embodiment, the roadway guideway 150 may be in a position in the center of the roadway 190, in a relatively high position above the roadway 190, as exemplified by the position D of the roadway guideway 150. And illustratively in an embodiment, the roadway guideway 150 may be disposed on the other side of the roadway 190, as exemplified by the position F of the roadway guideway 150. Moreover, in one specific roadway guideway 150 for a given segment of roadway, the position of the roadway guideway 150 relative to the roadway may vary, and may vary according to positioning considerations of the roadway guideway 150. For instance, the roadway guideway 150 described herein is above the roadway and therefore above road conditions such as snow. The height of the roadway guideway above a roadway may vary in response to vehicle clearance under the roadway guideway entry and exit operations, and/or in terrain considerations such as weather, as well as in response to considerations of the space around a roadway. Moreover, in embodiments of a transportation system, the roadway guideway 150 may be put off more to a side and lower, so that in a given envelope, multiple levels of roadway, sometimes called "double decking", may be more easily accommodated. And in an embodiment, the position of the roadway guideway may depend upon the mode of engagement of a coupled vehicle. For instance, a roadway vehicle that is about to disengage from the roadway guideway may favor a member 132 that is less overhead, so that the roadway guideway will be in a lower position beside the vehicle to facilitate uncoupling and/or exit. In an embodiment, during an operation of coupling an apparatus 120 to a roadway vehicle 180, the guideway 150 may be initially positioned in a low position relative to the roadway 190 moving towards illustratively the position G or the position A. The head unit 126 and coupling structure 128 therefore ride low, and the vehicle engagement structure 130 is brought into contact with the roadway vehicle 190, or structure 131 by lifting the vehicle engagement structure 130 off rest pads and using the yawing stability device 140 or bristle rudder thereof, or the like, to guide the vehicle engagement structure 130 to an approximate center of a lane of the roadway 190. In an embodiment, the reverse may occur in an exiting operation. Moreover, while the end of members 132 to engage a roadway vehicle are illustratively portrayed as being centered along the roadway, in other embodiments, they may be in another position of the roadway, and moreover, not all centered in precisely the same position, to spread wear on a roadway.

Figure 10:
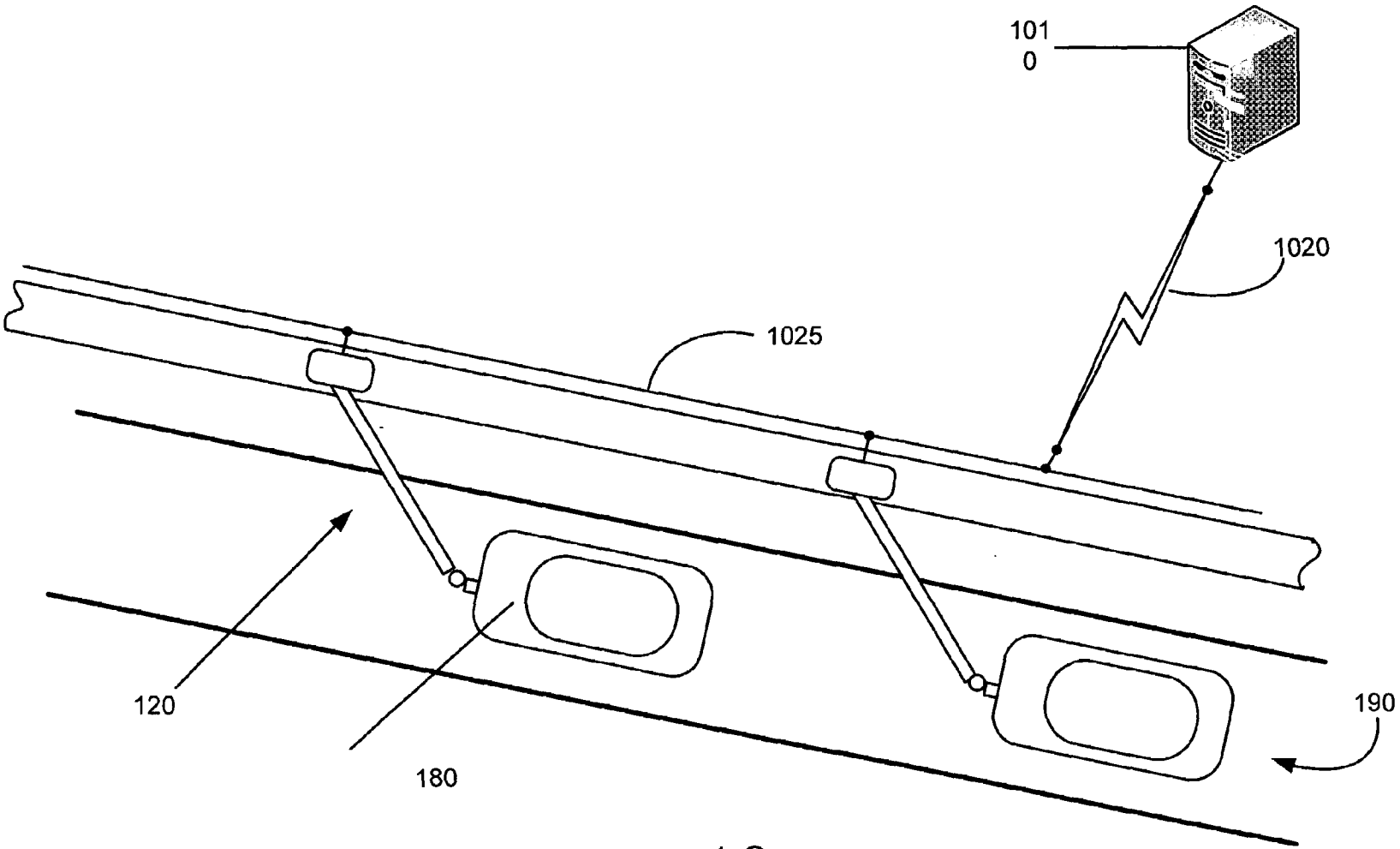
FIG. 10 portrays a top-side view diagram of an embodiment of the vehicle transportation system including an embodiment of a coupled programmed computer.

Now referring to FIG. 10, in an embodiment the operation of the apparatus 120 is controlled by a programmed computer 1010. As depicted herein, the programmed computer 1010 is operatively coupled to the vehicle transportation system 100 (FIG. 1) by a network 820. In an embodiment, the network 1020 is coupled to the roadway guideway 150, and in an embodiment is coupled to individual apparatus 120 by a connection 1025. In an embodiment, the network 1020 may be configured to transmit data through a solid medium such as through a metallic conductor or an optical fiber, and in an embodiment the network 1020 may be configured to transmit data wirelessly (through air), such as by a transmission of electromagnetic waves, acoustic waves photonic radiation, and the like. Moreover, in an embodiment, the processing unit 1010 may be operatively coupled to the vehicle transportation system 100 by a direct connection rather than a network 1020. In an embodiment, the connection 1025 may be a network or a direct connection, and may include a solid connection and/or a wireless connection. Moreover, in an embodiment the connection 1025 is a structure of the vehicle transportation system 110, and in an embodiment the connection 1025 is disposed at last partially within the roadway guideway 150.

In an embodiment, the programmed computer 1010 (or suite of separate processing components controlled by it) is programmed to control the movement of an apparatus 120 along the roadway guideway 150. In an embodiment, the programmed computer 1010 controls the movement of the apparatus 120 by executing an algorithm that is stored in a memory of the programmed computer 1010, or stored in a memory that is coupled to the programmed computer 1010.

In an embodiment, an indication of destination of each apparatus 120 that is coupled or to be coupled to a vehicle 180 is provided to the programmed computer 1010. In an embodiment, the vehicle operator or some other entity of each vehicle 180 indicates the vehicle's destination to the programmed computer 1010 through an interface. In an embodiment, the interface is disposed within a vehicle 180, which is coupled to the programmed computer 1010 via the data connection 133 described (FIG. 1).

In an embodiment, in indication of the position of each apparatus 120 along a roadway guideway 150 is provided to the programmed computer 1010. In an embodiment, an indication of the position of each vehicle 180 on a roadway 190 along the roadway guideway 150 is provided to the programmed computer 1010. In an embodiment, an indication of the position of each vehicle 180 coupled to an apparatus 120 is provided to the programmed computer 1010. In an embodiment, the vehicle transportation system 100 includes sensors disposed along the roadway guideway 150 and/or along the roadway 190 to detect the approximate position of an apparatus 120 or a vehicle 180 along the roadway guideway 150, and/or the roadway 190, and to provide the detected position to the programmed computer 1010. In an embodiment, the roadway guideway 150 includes these disposed sensors. In an embodiment, an apparatus 120 and/or a vehicle 180 includes a transmitting device to provide an indication of their position to the programmed computer 1010.

In an embodiment, the algorithm is configured to determine the speed, the force, and/or the like that the force generation unit 318 418 718 of an apparatus 120 is to generate. The programmed computer 1010 is configured to execute the algorithm and to provide to the apparatus 120 an indication of the speed, the force, and/or the like, that the force generation unit 318 of the apparatus 120 is to generate calculated by execution of the algorithm. The apparatus 120 is configured to receive the indication. The force generation unit 318 is configured to generate the indicted speed, force, and/or the like, from the received indication. In an embodiment, the algorithm is configured to determine the speed of each apparatus 120 dependent upon maintaining a predetermined minimum or preferred spacing between contiguous apparatus 120 based on criteria that may include traffic management (including re-entering transit), required braking distance, and speed constraints on each region of a roadway upon which each vehicle is disposed, and human factors considerations.

In an embodiment, the algorithm is configured to determine the route along the roadway guideway 150 that an apparatus 120 is to transit. In an embodiment, the algorithm is to determine whether the coupling components of an apparatus 120 are to be enabled or to be not enabled, at different positions of the route. The programmed computer 1010 is configured to execute the algorithm, and to provide to the apparatus 120 an indication of a coupling component of the apparatus 120 enablement or disenablement generated by algorithm execution. The apparatus 120 is configured to receive the indication and to enable and/or to disenable a coupling component according to the indication. In response to the apparatus 120 enabling and/or not enabling a coupling component, the apparatus 120 will transit the roadway guideway 150 as described with reference to FIGS. 3, 4, 7, and 8.

Figure 11A:
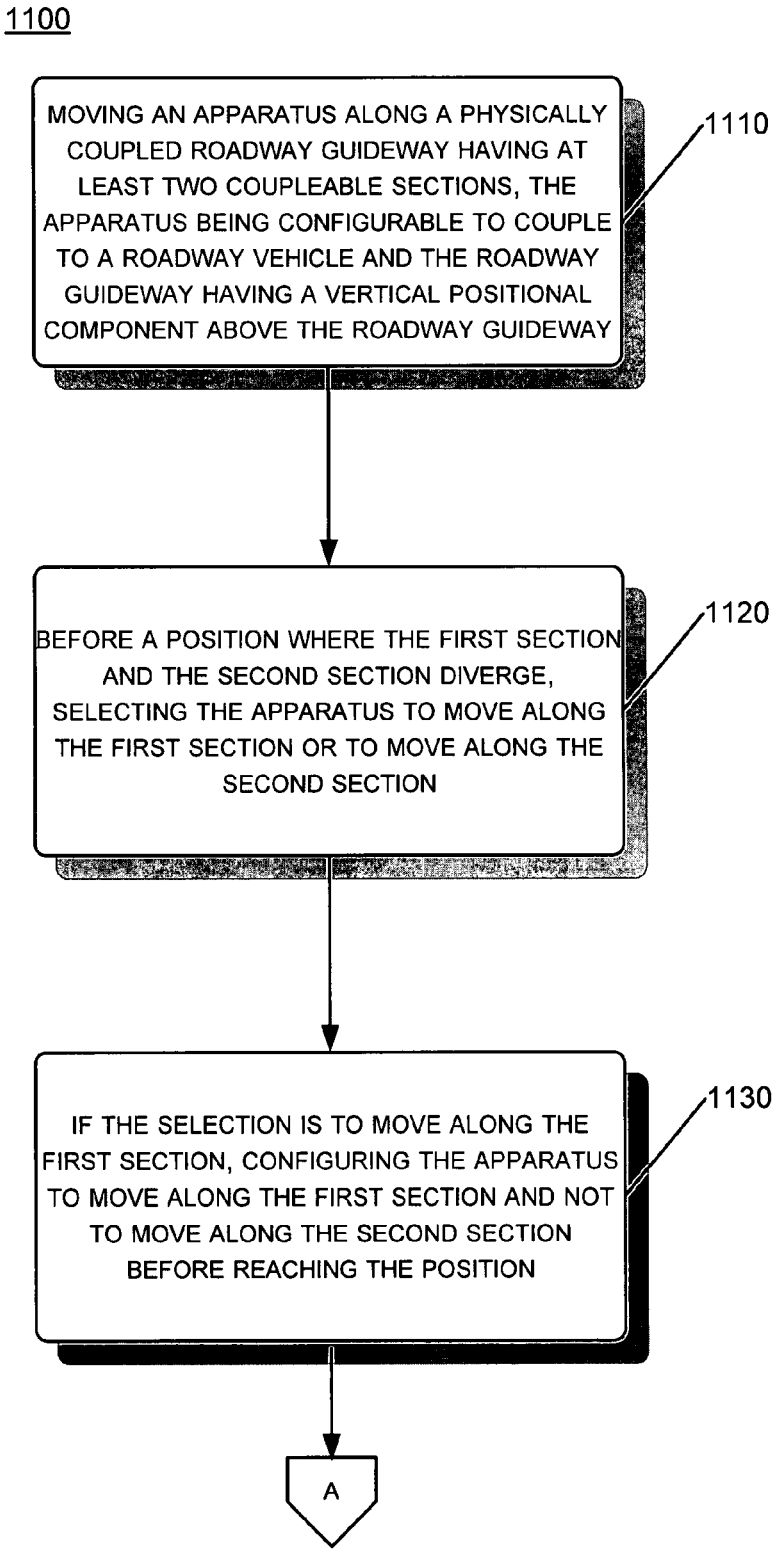
FIGS. 11A and 11B portray a flow chart of an embodiment of a method of an apparatus moving along a roadway guideway, and switching between sections of the roadway guideway.
Figure 11B:
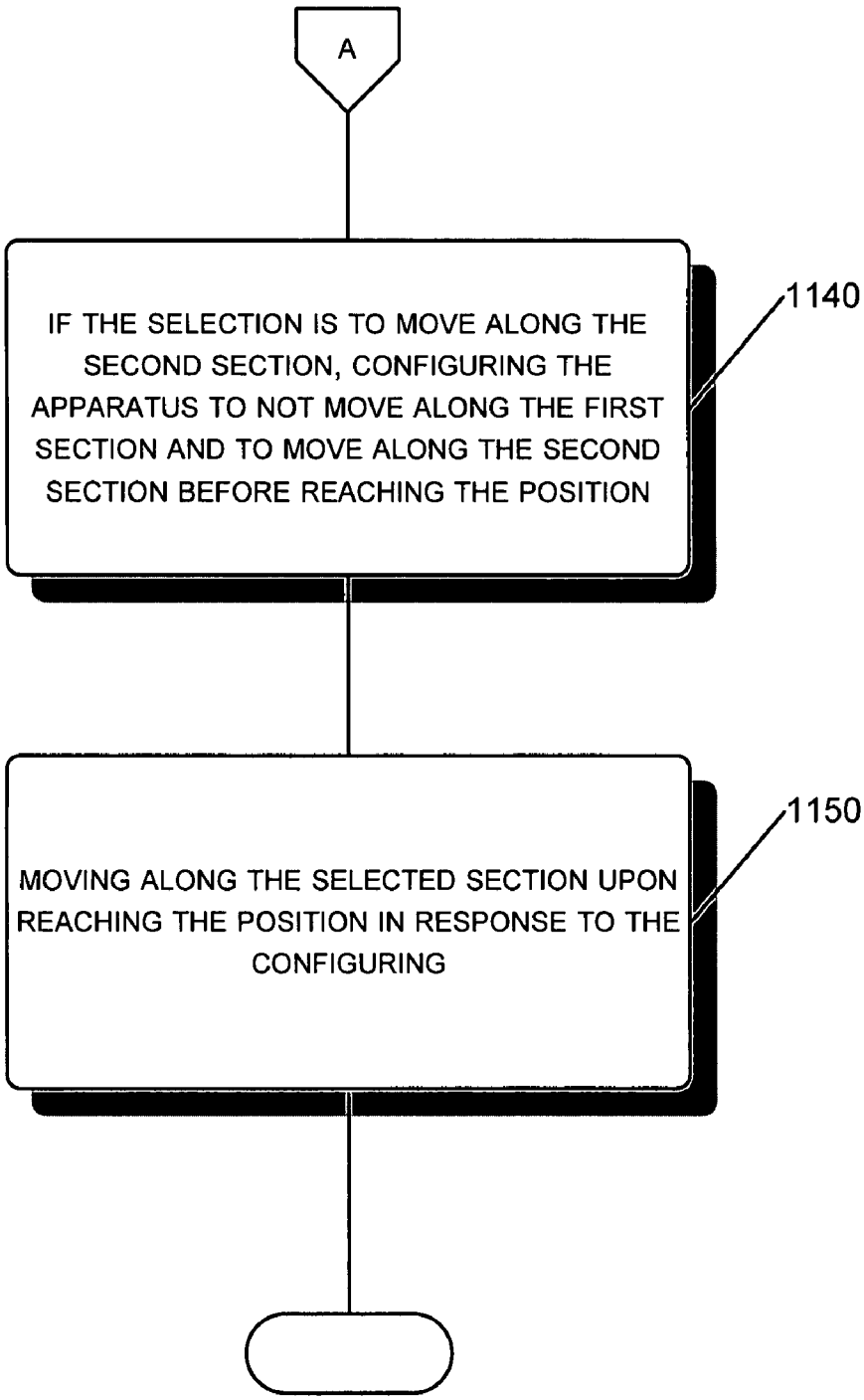

Referring now to FIGS. 11A and 11B, there is described an embodiment of a method 1100 of an apparatus moving along a roadway guideway, switching between sections of the roadway guideway, and/or exiting and entering the roadway guideway. The method includes in block 1110, moving an apparatus along a roadway guideway to which it is physically coupled. The roadway guideway has at least two sections that are longitudinally disposed along the roadway guideway in an approximately defined position relative to one another. The sections are herein termed a first section, and a second section. The apparatus is of a type that is configurable to couple to a roadway vehicle disposed on the surface of a roadway, and the roadway guideway is positioned vertically above the surface. Embodiments of such an apparatus, such a roadway guideway, and such guideway sections, have been described above with reference to FIGS. 1, 2, 3, 4, 5, 7, 8, 9, and 10.

The method 1100 includes in block 1120, while the apparatus is at a position along the roadway guideway before a position where the first section and the second section diverge from the defined position, such as where the apparatus should not be physically coupled to both the first section and the second section at the same time, selecting between the apparatus moving along the first section and the apparatus moving along the second section. In an embodiment, the selecting action my be implemented in response to an operator selection that may be provided, in an embodiment, from a user interface. In an embodiment, the selection action may be implemented in response to a signal provided by a programmed computer, that executes a program to select the first section or the second section, or accesses the selection from a stored record The method 1100 includes in block 1130 configuring the apparatus to move along the first section and not move along the second section at the position where the first section and the second section diverge, if the selection made in block 1120 is to move along the first section at the position. In an embodiment, the configuring action may include physically coupling the apparatus to the first section if the apparatus was not already physically coupled to the first section, and physically decoupling the apparatus from the second section if the apparatus was not already physically decoupled from the second section before moving to the position where the first section and the second section diverge. Embodiments of physically coupling, and/or physically decoupling, the apparatus to a section have been described above with reference to FIGS. 1, 3, 4, 7, and 8. Moreover, illustratively, the action of physically coupling the apparatus to the first section includes positioning an element of the apparatus in a pocket of the first section, and illustratively the action of physically decoupling the apparatus from the second section includes positioning an element of the apparatus out of a pocket of the second section, as described above with reference to FIGS. 3,4, 7, and 8.

The method 1100 includes in block 1140 configuring the apparatus to move along the second section and to not move along the first section at the position where the first section and the second section diverge, if the selection made in block 1120 is to move along the second section at the position where the first section and the second section diverge. In an embodiment, the configuring action may include physically coupling the apparatus to the second section if the apparatus was not already physically coupled to the second section, and physically decoupling the apparatus from the first section if the apparatus was not already physically decoupled from the first section before moving to the position. Embodiments of physically coupling, and/or decoupling, the apparatus to a section have been described above with reference to FIGS. 1, 3, 4, 7, and 8. Moreover, illustratively, the action of physically coupling the apparatus to the second section includes positioning an element of the apparatus in a pocket of the second section, and illustratively the action of physically decoupling the apparatus from the first section includes positioning an element of the apparatus out of a pocket of the first section, as described above with reference to FIGS. 3,4, 7, and 8 It is understood that in an embodiment, components, structures, acts, and the like described herein may include in whole or in part identical elements and acts, and moreover may be the identical component, structure, act, and the like described elsewhere as having a different name. Moreover, elements have been illustratively described as being components of specific aggregated structures. For instance, a coupling component 310, 340, 440, and 450; and a force generation unit 318 have been illustratively described as being components of a head unit 126. And for instance, a head unit 126, a coupling structure 128, and a vehicle engagement structure 130 have been illustratively described as being components of an apparatus 120. And illustratively, a member 132, a joint 138, and an engagement structure 130 have been described as being components of a coupling structure 128. These aggregations are merely illustrative, and the transportation vehicle system could have been described using different aggregations of structure.

Although the present invention has been described in connection with specific embodiments, those of ordinary skill in the art will understand that many other modifications can be made to the invention within the scope of the claims that follow. Accordingly, it is not intended that the scope of the invention in any way be limited by the above description, but instead be determined entirely by reference to the claims that follow. With regard to the claims, the order of description of acts or operations should not be construed to imply that these acts or operations are necessarily order dependent.

It is understood moreover that in general, terms used herein, and especially in the appended claims, are generally intended as "open" terms (e.g., the term "including" and should be interpreted as "including but not limited to," the term "having" should be interpreted as "having at least," the term "includes" should be interpreted as "includes but is not limited to," "comprise" and variations thereof, such as, "comprises" and "comprising"0 are to be construed in an open, inclusive sense, that is as "including, but not limited to," etc.) unless specifically stated otherwise. It is understood that if an illustrative "first item" and an illustrative "second item" compose an element or act or the like, then the element, act, or the like includes the first item and the second item in the open sense. It is be further understood that if a specific quantity is intended in a claim recitation, such an intent will be explicitly recited in the claim, and in the absence of such recitation no such intent is present. For example, as an aid to understanding, the following appended claims may contain usage of the introductory phrases "at least one" and "one or more" to introduce claim recitations. Moreover, as used herein, the meaning of "attach" and variants thereof, unless otherwise stated, may include being removably attached. And moreover, as used herein, the term "and/or", unless otherwise stated, should be interpreted as one or more of the items. Illustratively, for three items "A," "B," and "C," the phrase "A, B, and/or C" (or "A; B; and/or C") shall be understood to mean at least one of the items in the group consisting of the item "A," the item "B," and the item "C," the possibilities being (in the alternative): "A"; "B"; "C"; "A" and "B"; "A" and "C"; "B" and "C"; or "A", "B", and "C".

What is claimed is:

1. An apparatus comprising:

a guideway coupling structure configured to physically couple the apparatus to a roadway guideway;

a force generation unit configured to generate a first force to move the apparatus along a physically coupled roadway guideway, and a second force to tow a coupled roadway vehicle; and a vehicle coupling structure configured to couple the apparatus to the roadway vehicle, to transmit the second force from the apparatus to the coupled roadway vehicle as the apparatus moves along the roadway guideway in response to the first force, including a spanning structure configured to approximately span the distance between a coupled roadway vehicle and the roadway guideway and to maintain a substantially rigid structure when towing or braking a coupled roadway vehicle at roadway speed, and including a structure operative to transmit electrical power to a coupled roadway vehicle.

2. An apparatus comprising:

a guideway coupling structure configured to physically couple the apparatus to a roadway guideway;

a force generation unit configured to generate a first force to move the apparatus along a physically coupled roadway guideway, and a second force to tow a coupled roadway vehicle; and a vehicle coupling structure configured to couple the apparatus to the roadway vehicle, to transmit the second force from the apparatus to the coupled roadway vehicle as the apparatus moves along the roadway guideway in response to the first force, including a spanning structure configured to approximately span the distance between a coupled roadway vehicle and the roadway guideway and to maintain a substantially rigid structure when towing or braking a coupled roadway vehicle at roadway speed, and including a spanning structure to approximately span the distance between the vehicle and the roadway guideway; and a joint between the spanning structure and a coupled vehicle to permit a coupled roadway vehicle to yaw that is elastic with respect to yawing about an approximate vertical axis in response to a torque about the approximate vertical axis, such that if the joint yaws in response to the torque, the joint then approximately returns to lateral alignment.

3. An apparatus comprising:

a guideway coupling structure configured to physically couple the apparatus to a roadway guideway;

a force generation unit configured to generate a first force to move the apparatus along a physically coupled roadway guideway, and a second force to tow a coupled roadway vehicle; and a vehicle coupling structure configured to couple the apparatus to the roadway vehicle, to transmit the second force from the apparatus to the coupled roadway vehicle as the apparatus moves along the roadway guideway in response to the first force, including a spanning structure configured to approximately span the distance between a coupled roadway vehicle and the roadway guideway and to maintain a substantially rigid structure when towing or braking a coupled roadway vehicle at roadway speed including a spanning structure to approximately span the distance between the vehicle and the roadway guideway;

and a joint between the spanning structure and a coupled vehicle to permit the roadway vehicle to roll about an approximate lengthwise axis of the vehicle, that is elastic with respect to rolling about an approximate lengthwise axis of a coupled vehicle such that in response to a torque about the lengthwise axis, if the joint rolls, the joint then approximately returns to longitudinal alignment.

4. An apparatus comprising:

a guideway coupling structure configured to physically couple the apparatus to a roadway guideway, and including a first coupling structure configurable to physically couple the apparatus to a longitudinally disposed first section of the roadway guideway, and a second coupling structure configurable to physically couple the apparatus to a longitudinally disposed second section of the roadway guideway; wherein the first coupling structure is further configurable to vertically support the apparatus to the first section of the roadway guideway, and/or the second coupling structure is further configurable to vertically support the apparatus to the second section of the roadway guideway a force generation unit configured to generate a first force to move the apparatus along a physically coupled roadway guideway, and a second force to tow a coupled roadway vehicle; and a vehicle coupling structure configured to couple the apparatus to the roadway vehicle, to transmit the second force from the apparatus to the coupled roadway vehicle as the apparatus moves along the roadway guideway in response to the first force, and including a spanning structure configured to approximately span the distance between a coupled roadway vehicle and the roadway guideway and to maintain a substantially rigid structure when towing or braking a coupled roadway vehicle at roadway speed.

5. A system comprising:

a roadway guideway having multiple longitudinally disposed guideway structures; and an apparatus having a coupling device configured to selectively physically couple the apparatus to individual longitudinally disposed structures, and selectively physically de-couple the apparatus from any of said longitudinally disposed structures; and having a vehicle coupling structure configured to couple the apparatus to a roadway vehicle disposed on a roadway whereby when at least one of said guideway structures diverge, the apparatus is operative to selectively track the diverging guideway structure by coupling to at least one of said diverging guideway structures, and by decoupling from the remaining guideway structures;

the vehicle coupling structure includes a joint to permit a coupled roadway vehicle to yaw, to roll, and/or to pitch with respect to the vehicle; and the joint is configured to yaw elastically about an approximate vertical axis; and/or the joint is configured to roll elastically about an approximate lengthwise axis of a coupled vehicle.

6. A system comprising:

a roadway guideway having multiple longitudinally disposed guideway structures, the roadway guideway including a first longitudinally disposed structure configured to be physically coupled by a first coupling structure of the apparatus, and a second longitudinally disposed structure configured to be physically coupled by a second coupling structure of the apparatus, the first longitudinally disposed structure having a first cavity, and the second longitudinally disposed structure having a second cavity and an apparatus having a coupling device configured to selectively physically couple the apparatus to individual longitudinally disposed structures, and selectively physically de-couple the apparatus from any of said longitudinally disposed structures; and having a vehicle coupling structure configured to couple the apparatus to a roadway vehicle disposed on a roadway;

the coupling device including a first coupling structure having an element switchably positionable in the cavity to selectively physically couple and decouple the apparatus to the first longitudinally disposed structure, and a second coupling structure having an element switchably positionable in the cavity to selectively physically couple and decouple the apparatus to the second longitudinally disposed structure, whereby when at least one of said guideway structures diverge, the apparatus is operative to selectively track the diverging guideway structure by coupling to at least one of said diverging guideway structures, and by decoupling from the remaining guideway structures, and to move along the first longitudinally disposed structure by coupling to the first longitudinally disposed structure and by decoupling from the second longitudinally, and to move along the second longitudinally disposed structure by decoupling from the first longitudinally disposed structure and by coupling to the second longitudinally disposed structure.

7. The system defined in claim 6 wherein the first cavity is defined by two opposed surfaces, and the second cavity is defined by two opposed surfaces.

8. The system defined in claim 7 wherein the opposed surfaces that define the first cavity are at least approximately parallel to one another.

9. The system defined in claim 7 wherein the opposed surfaces that define the second cavity are at least approximately parallel to one another.

10. A system comprising:

a roadway guideway having multiple longitudinally disposed guideway structures; and an apparatus having a coupling device configured to selectively physically couple the apparatus to individual longitudinally disposed structures, and selectively physically de-couple the apparatus from any of said longitudinally disposed structures; and having a vehicle coupling structure configured to couple the apparatus to a roadway vehicle disposed on a roadway, including a structure operative to transmit electric power to a coupled roadway vehicle;

whereby when at least one of said guideway structures diverge, the apparatus is operative to selectively track the diverging guideway structure by coupling to at least one of said diverging guideway structures, and by decoupling from the remaining guideway structures.

11. An apparatus comprising:

an element configured to couple to a roadway vehicle, and/or a structure attached to the roadway vehicle; and a first coupling component switchably configured to laterally constrain the apparatus to a first roadway guideway structure; and a second coupling component switchably configured to laterally constrain the apparatus to a second roadway guideway structure; and wherein the apparatus is configured to move along the first roadway guideway structure when the first coupling component is switched to laterally constrain the apparatus to the first roadway guideway structure and the second coupling component is switched to not laterally constrain the apparatus to the second roadway guideway structure;

move along the second roadway guideway structure when the second coupling component is switched to laterally constrain the apparatus to the second roadway guideway structure and the first coupling component is switched to not laterally constrain the apparatus to the first roadway guideway structure; and move along both the first roadway guideway structure and the second roadway guideway structure when the first coupling component is switched to laterally constrain the apparatus to the first roadway guideway structure, the second coupling component is switched to laterally constrain the apparatus to the second roadway guideway structure, and the first roadway guideway and the second roadway guideway structures are in a defined position relative to one another.

12. The apparatus defined in claim 11 wherein the first roadway guideway structure comprises a first cavity, and the first coupling component comprises an element switchably positionable in the cavity wherein the first coupling structure laterally constrains the apparatus to the first guideway structure when the first coupling component is positioned in the cavity.

13. The apparatus defined in claim 12 wherein the first cavity comprises two approximately opposed surfaces.

14. The apparatus defined in claim 11 wherein the second roadway guideway structure comprises a second cavity, and the second coupling component comprises an element switchably positionable in the cavity wherein the second coupling structure laterally constrains the apparatus to the second guideway structure when the second coupling component is positioned in the cavity.

15. The apparatus defined in claim 14 wherein the second pocket comprises two approximately opposed surfaces.

16. The apparatus defined in claim 11 further comprising a force generation unit to generate a force to tow the roadway vehicle along a roadway guideway structure when the apparatus is coupled to the roadway vehicle and the apparatus is configured to move along the roadway guideway structure.

17. The apparatus defined in claim 11 further comprising a brake configured to decelerate the apparatus in moving along the first roadway guideway structure when the apparatus is moving along the first roadway guideway structure; and configured to decelerate the apparatus in moving along the second roadway guideway structure when the apparatus is moving along the second roadway guideway structure.

18. The apparatus defined in claim 17 wherein the brake is configured to decelerate the apparatus in moving along a guideway structure by applying a frictional force to the guideway structure.

19. The apparatus defined in claim 11 wherein the first roadway guideway structure is configurable to have a range of vertical displacement; and/or a range of horizontal displacement with respect to a roadway upon which the vehicle is disposed when the first coupling component constrains the apparatus to the approximate lateral position of the first roadway guideway structure; and the second roadway guideway structure is configurable to have a range of vertical displacement; and/or a range of horizontal displacement with respect to a roadway upon which the vehicle is disposed when the second coupling component constrains the apparatus to the approximate lateral position of the second roadway guideway structure.

* * * * *